US011363862B2

(12) United States Patent
Cheng et al.

(10) Patent No.: US 11,363,862 B2
(45) Date of Patent: Jun. 21, 2022

(54) ILLUMINATED TREKKING POLE

(71) Applicant: Belgravia Wood Limited, Tortola (VG)

(72) Inventors: Elmer Chi Hang Cheng, Hong Kong (CN); Victor Hugo Ocegueda Gallaga, Baja California (MX)

(73) Assignee: Belgravia Wood Limited, Tortola (VG)

( * ) Notice: Subject to any disclaimer, the term of this patent is extended or adjusted under 35 U.S.C. 154(b) by 239 days.

(21) Appl. No.: 16/757,015

(22) PCT Filed: Jan. 21, 2020

(86) PCT No.: PCT/US2020/014349
§ 371 (c)(1),
(2) Date: Apr. 17, 2020

(87) PCT Pub. No.: WO2021/021241
PCT Pub. Date: Feb. 4, 2021

(65) Prior Publication Data

US 2021/0401131 A1 Dec. 30, 2021

(30) Foreign Application Priority Data

Jul. 31, 2019 (CN) ..... 201921220456.3
Oct. 19, 2019 (CN) ..... 201921756973.2

(51) Int. Cl.
*A45B 3/04* (2006.01)
*A45B 9/04* (2006.01)
(Continued)

(52) U.S. Cl.
CPC ..... *A45B 3/04* (2013.01); *A45B 9/02* (2013.01); *A45B 9/04* (2013.01); *F21V 5/04* (2013.01);
(Continued)

(58) Field of Classification Search
CPC ..... A45B 3/02–04; A45B 9/02–04; A45B 2900/002–005; A45B 2200/05; F21V 5/04; F21V 23/023–0428
See application file for complete search history.

(56) References Cited

U.S. PATENT DOCUMENTS 3,995,653 A 12/1976 Mackal et al.
4,206,445 A 6/1980 Steinhauer
(Continued)

*Primary Examiner* — Jason M Han
(74) *Attorney, Agent, or Firm* — Troutman Pepper Hamilton Sanders LLP; Ryan A. Schneider; Christopher C. Close, Jr.

(57) ABSTRACT

An illumination system for a handheld support apparatus is disclosed. A variety of applications for the handheld support apparatus are considered, including, but not limited to, hiking, downhill skiing, cross-country skiing, trailblazing, rock climbing, and mountaineering. The illumination system can advantageously illuminate the surrounding environment of the handheld support apparatus during use. Illumination systems can be disposed within the support apparatus or on the external surface of the support apparatus. The illumination system can comprise a power source and a light-emitting device. The illumination system can further comprise at least one internal electrical conductor configured to transfer power from the power source to the light-emitting device. In some embodiments, the light-emitting from the support apparatus can be controlled by predetermined values to optimize preferred performance parameters.

28 Claims, 18 Drawing Sheets

(51) Int. Cl.

| | |
|---|---|
| ***A45B 9/02*** | (2006.01) |
| ***F21V 23/02*** | (2006.01) |
| ***F21V 23/04*** | (2006.01) |
| ***F21V 5/04*** | (2006.01) |
| ***A45B 9/00*** | (2006.01) |

(52) U.S. Cl.

CPC ..... *F21V 23/023* (2013.01); *F21V 23/04* (2013.01); *A45B 2009/002* (2013.01); *A45B 2009/005* (2013.01); *A45B 2200/05* (2013.01)

(56) References Cited

U.S. PATENT DOCUMENTS

| | | | | |
|---|---|---|---|---|
| 5,271,640 | A | 12/1993 | Potochick et al. | |
| 6,152,491 | A | 11/2000 | Queentry | |
| 6,164,314 | A | 12/2000 | Saputo et al. | |
| 6,648,004 | B2 | 11/2003 | Lau | |
| 6,990,994 | B2 | 1/2006 | Reeb et al. | |
| 7,273,065 | B1 | 9/2007 | Robbins | |
| 8,746,264 | B2 * | 6/2014 | Gorey ..... | A63C 11/225 135/65 |
| D715,898 | S | 10/2014 | Chen | |
| 9,169,836 | B2 | 10/2015 | Yang | |
| 9,505,334 | B2 | 11/2016 | Maness et al. | |
| 2008/0223449 | A1 | 9/2008 | Culp et al. | |
| 2014/0238505 | A1 | 8/2014 | Petersen | |
| 2018/0008021 | A1 | 1/2018 | Heim | |
| 2018/0036624 | A1 | 2/2018 | Muuli et al. | |

* cited by examiner

ILLUMINATED TREKKING POLE

CROSS-REFERENCE TO RELATED APPLICATIONS

This application is a national stage application, filed under 35 U.S.C. § 371, of International Patent Application No. PCT/US2020/014349, filed on 21 Feb. 2020, which claims benefit under 35 U.S.C. § 119(a), of Chinese Patent App. No. 201921756973.2, filed 19 Oct. 2019, and Chinese Patent App. No. 201921220456.3, filed 31 Jul. 2019, the entire contents and substance of which are incorporated herein by reference in their entirety.

FIELD OF THE DISCLOSURE

Aspects of the present disclosure relate to an improved illuminated handheld support pole or portions thereof, and, more particularly, to an illuminated trekking pole.

BACKGROUND

The human body is built having a high center of gravity when standing upright. During rigorous movement, balance and stability can be improved using legs, arms, or some form of support apparatus. It is no surprise, therefore, that vigorous and demanding activities make use of support apparatuses to improve balance and stability.

During activities such as snow skiing, hiking, and other trekking activities, for instance, handheld poles are used for propulsion, balance, and stability. The high speeds of downhill skiing, the quick maneuvers of slalom and mogul skiing, and the taxing endurance of cross-country skiing all necessitate handheld poles to aid in successfully and safely completing the activity. Similarly, the uneven terrain, unexpected obstacles, and complete wilderness mean handheld poles are imperative for survival. Failure to provide adequate support and stability can lead to falls, wipeouts, and serious injuries.

As handheld support poles are used in activities that are often remote, such as hiking or skiing, consumer safety is a primary concern. Because handheld support poles are imperative for survival, losing one or both poles can lead to disaster. Additionally, in remote locations with little infrastructure or human contact, the danger to consumer safety increases by orders of magnitude during the night time. Consumers are unable to clearly see their surroundings, difficult to be sighted by potential rescue or aid workers, and unable to easily locate the handheld support poles in the event of a loss of one or more poles.

What is needed, therefore, is a handheld support apparatus that meets all the safety and durability standards of commonly used poles and that can produce a light to illuminate the apparatus itself as well as its surroundings. Embodiments of the present disclosure address this need as well as other needs that will become apparent upon reading the description below in conjunction with the drawings.

SUMMARY

Embodiments of the present disclosure relate generally to an illuminated handheld support apparatus, and, more particularly, to an illuminated trekking pole.

Aspects of the present disclosure relate to a handheld apparatus. In some embodiments, the handheld apparatus can comprise a substantially hollow shaft having a tip end and a grip end. For instance, the substantially hollow shaft can be made of Aluminum. In some embodiments, the handheld apparatus can comprise a shaft tip attached to the tip end of the substantially hollow shaft. For instance, the shaft tip can be made of Aluminum. In some embodiments, the handheld apparatus can comprise a grip handle. In some embodiments, the grip handle is configured to detachably attach to the grip end of the substantially hollow shaft. In some embodiments, the substantially hollow shaft can further comprise grooves to rotationally lock the grip in a fixed position. In some embodiments, the grip handle can further comprise an adjustable strap fastening device. For instance, the grip handle can comprise an adjustable strap made of polyethylene yarn, leather, or any suitable material. In some embodiments, the adjustable strap fastening device further comprises an adjustable locking mechanism configured to control the size of the adjustable strap fastening device. In some embodiments, the handheld apparatus can comprise a basket or other flange-like component radially disposed on the shaft tip. In some embodiments, the basket or other flange-like component can be configured to detachably attach to the shaft tip. For example, a basket made of thermoplastic elastomer or any suitable material can be detachably attached to the shaft tip. In some embodiments, the handheld apparatus can comprise an illumination system. In some embodiments, the illumination system can comprise a power source, a light-emitting device, at least one internal electrical conductor at least partially contained within the substantially hollow shaft, and a power source housing. In some embodiments, the light-emitting device can be a Light Emitting Diode (LED). In some embodiments, the light-emitting device can be a Printed Circuit Board (PCB) with integrated LEDs. In some embodiments, the light-emitting device can further comprise a protective cover. In some embodiments, the light-emitting device can further comprise a heat dissipation device. In some embodiments, the at least one internal electrical conductor can be configured to transfer power from the power source to the light-emitting device. In some embodiments, the power source housing can be at least partially contained within the substantially hollow shaft or at least partially contained within the grip. In some embodiments, the power source housing can comprise a negative contact surface. In some embodiments, the grip further comprises a power source housing cover configured to detachably attach to the grip and/or the power source housing. In some embodiments, the housing cover can further comprise a button configured to transition between an on position and an off position. In some embodiments, the illumination system further comprises a controller assembly, comprising a control circuitry device, an input component, and a positive contact surface. In some embodiments, the controller assembly is configured to detachably attach to the power source housing and the power source housing cover. In some embodiments, the controller assembly is contained at least partially within the grip handle and/or the substantially hollow shaft.

BRIEF DESCRIPTION OF THE DRAWINGS

The accompanying drawings, which are incorporated in and constitute a part of this specification, illustrate multiple embodiments of the presently disclosed subject matter and serve to explain the principles of the presently disclosed subject matter. The drawings are not intended to limit the scope of the presently disclosed subject matter in any manner.

DETAILED DESCRIPTION

Figure 1:
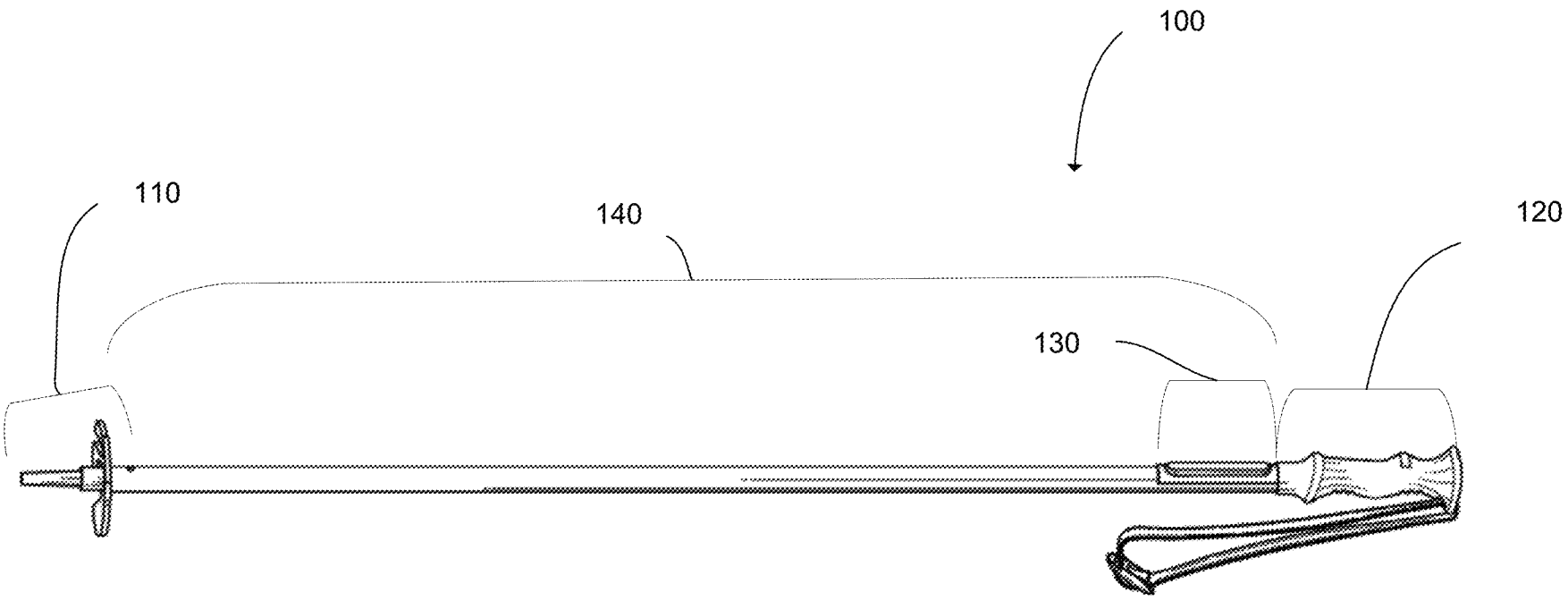
FIG. 1 is a perspective view of an illuminated trekking pole wherein the illumination system is integrated within the substantially hollow shaft according to an example embodiment of the present disclosure.

Although certain embodiments of the disclosure are explained in detail, it is to be understood that other embodiments are contemplated. Accordingly, it is not intended that the disclosure is limited in its scope to the details of construction and arrangement of components set forth in the following description or illustrated in the drawings. Other embodiments of the disclosure are capable of being practiced or carried out in various ways. Also, in describing the embodiments, specific terminology will be resorted to for the sake of clarity. It is intended that each term contemplates its broadest meaning as understood by those skilled in the art and includes all technical equivalents which operate in a similar manner to accomplish a similar purpose.

It should also be noted that, as used in the specification and the appended claims, the singular forms "a," "an" and "the" include plural references unless the context clearly dictates otherwise. References to a composition containing "a" constituent is intended to include other constituents in addition to the one named.

Ranges may be expressed herein as from "about" or "approximately" or "substantially" one particular value and/or to "about" or "approximately" or "substantially" another particular value. When such a range is expressed, other exemplary embodiments include from the one particular value and/or to the other particular value.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" are intended to be open-ended and to reflect that structure, material, or acts are not necessary, the failure to use such terms is not intended to reflect that structure, material, or acts are essential. To the extent that structure, material, or acts are presently considered to be essential, they are identified as such.

It is also to be understood that the mention of one or more method steps does not preclude the presence of additional method steps or intervening method steps between those steps expressly identified. Moreover, although the term "step" may be used herein to connote different aspects of methods employed, the term should not be interpreted as implying any particular order among or between various steps herein disclosed unless and except when the order of individual steps is explicitly required.

The components described hereinafter as making up various elements of the disclosure are intended to be illustrative and not restrictive. Many suitable components that would perform the same or similar functions as the components described herein are intended to be embraced within the scope of the disclosure. Such other components not described herein can include, but are not limited to, for example, similar components that are developed after development of the presently disclosed subject matter.

Skiing and hiking are both activities which use handheld poles for stability and support. Lack of stability and support during in these activities can lead to falls and major injuries. In many situations, the durations of these activities are limited by sunlight hours as they can become unsafe in darkness and reduced visibility. As such, the loss of a pole in reduced visibility environments can lead to hazardous and unsafe conditions for skiing and hiking.

To alleviate issues associated with the use of traditional poles for skiing and hiking, and to provide further advantages, the present disclosure comprises an illuminated handheld support apparatus. This support apparatus can comprise a hollow shaft, a tip, a basket, and a handle as would be known to one of ordinary skill in the art. To provide an illumination from the apparatus to improve visibility and safety, components of an illumination system can be provided within the substantially hollow shaft, shaft tip, and/or grip handle. For example, the illumination system can comprise a power source, a light-emitting device, at least one internal electrical conductor, a power source housing, and a controller assembly.

In some embodiments, the power source can be provided in the form of a battery and can provide power to the light-emitting device via the at least one internal electrical conductor. For instance, the light-emitting device can be in the form of a light-emitting diode (LED) or a printed circuit board (PCB) with integrated LEDs and can receive power from a battery via a copper wire. The light-emitting device can be on the external surface of the shaft, distributed and integrated throughout the length of the shaft, on the grip handle, distributed and integrated within the grip handle, or any combination thereof. In some embodiments, the light-emitting device can further comprise a protective covering to shield the light-emitting device from the harsh weather conditions. As would be appreciated by one of ordinary skill in the art, such an embodiment could provide an illuminated apparatus during a snowstorm to much more easily locate the apparatus even if buried under snow. To control the illumination system, some embodiments can provide a controller assembly comprising a control circuitry device and an input component. The controller assembly can further comprise a switch, button, wheel, or any actuating device operable to mechanically control the power transferred from the power source to the light-emitting device. For example, the actuating device can be a button operable to turn the illumination system on or off. In other embodiments, the actuating device can be a dial operable to rotate and change the light intensity of the illumination system. As would be appreciated by one of ordinary skill in the art, such an embodiment having a variable intensity would be operable to extend and prolong operating life if a finite power source is used, such as a battery. The illumination system can be configured to produce light at a predetermined angle and distance from the handheld pole. As would be appreciated by one of ordinary skill in the art, the illumination system can be configured to project light from 0.5 m to 3.5 m in front of the apparatus to allow the user to clearly see the upcoming terrain and surroundings in reduced visibility conditions. Additionally, the illumination system can be configured to produce light at a predetermined width and distribution. For example, the light from the illumination system can have a width of 1.25 m at full intensity such that the user can clearly visualize the surrounding area.

Various devices are disclosed for providing an illuminated trekking pole, and exemplary embodiments of the devices will now be described with reference to the accompanying figures. Referring now to the figures, wherein like reference numerals represent like parts throughout the views, exemplary embodiments will be described in detail. FIG. 1 depicts an exemplary embodiment of an illuminated trekking pole 100. In some embodiments, the illuminated handheld support apparatus 100 can comprise a substantially hollow shaft 140, a shaft tip assembly 110, a grip handle 120, and an illumination system 130. As shown in FIG. 1, the illumination system 130 can be integrated within the substantially hollow shaft 140. The substantially hollow shaft 140 can connect to the shaft tip assembly 110 at one end and to the grip handle 120 at the other. In some embodiments, the illumination system 130, the shaft tip assembly 110, and the grip handle 120 can be configured to detachably attach to the hollow shaft 140. As will be appreciated, such an embodiment allows for ease of transport of the illuminated trekking pole 100 by reducing the overall product length during transport. A further benefit provided by the modular nature of the trekking pole assembly 100 may be that trekking pole 100 may be customizable by a user. For example, a user may choose to replace a standard grip handle 120 with one customized to fit the user's hand. As another example, a user may choose a substantially hollow shaft 140 that is designed based on the user's height.

The shaft 140, as depicted in FIG. 1, can comprise any material suitable to confer certain properties to the trekking pole 100 as preferred by one of ordinary skill in the art. Suitable examples of such a material include, but are not limited to, aluminum, stainless steel, carbon fiber, or a combination thereof. In some embodiments, the hollow shaft can be made in a manner to be adjustable for the user. For example, the hollow shaft can further comprise of telescopic hollow shaft segments operable to change the length of the hollow shaft. As would be appreciated by one of ordinary skill in the art, such an embodiment would confer universality onto the product, allowing the user to adjust the apparatus to the proper length no matter the height of the user.

Figure 2:
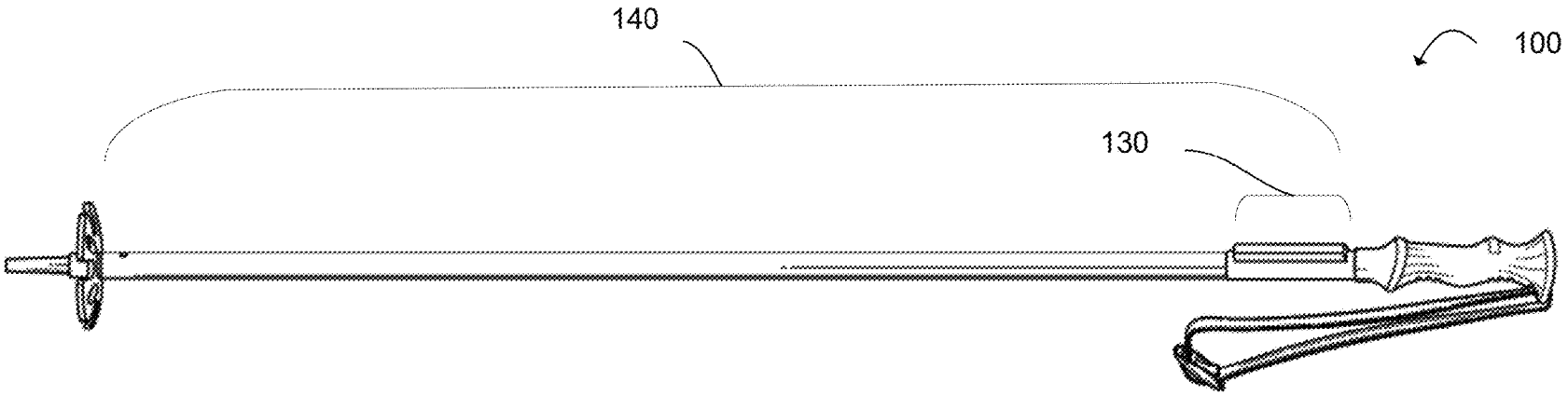
FIG. 2 is a perspective view illustrating an illuminated trekking pole wherein the illumination system is integrated on and around the substantially hollow shaft according to an example embodiment of the present disclosure.
Figure 3:
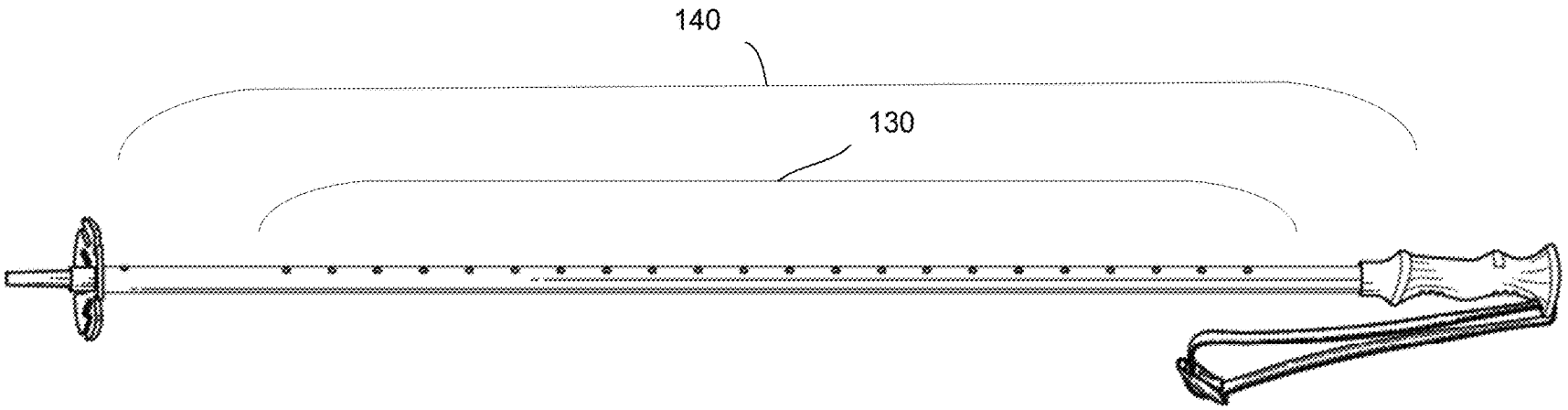
FIG. 3 is a perspective view illustrating an illuminated trekking pole wherein the illumination system is integrated within and throughout the substantially hollow shaft according to an example embodiment of the present disclosure.

As depicted in FIG. 1, illumination system 130 can be integrated within the substantially hollow shaft 140. In alternate embodiments described further herein with reference to FIGS. 2 and 3, the illumination system 130 may be disposed on an external surface of the hollow shaft 140 (e.g., FIG. 2) or may be distributed and integrated throughout the substantially hollow shaft 140 (e.g., FIG. 3). Those in the art will understand that a number of variations may be made in the disclosed embodiments, all without departing from the scope of the invention. For example, in some embodiments trekking pole 100 may include multiple illumination systems 130 within or upon the surface of the hollow shaft 140. In some embodiments, illumination system 130 may be oriented about and/or along multiple axis of hollow shaft 140. For example, in some embodiments, illumination system may be oriented along a front portion of the pole (e.g., oriented such as to align with a front facing direction of a user) and a back portion (e.g., oriented such as to align with in opposite of the forward direction of a user). Further, illumination system 130 may be oriented around hollow shaft 140. In other examples, illumination system 130 may include multiple components positioned at various locations within or upon the surface of the hollow shaft 140.

Figure 4:
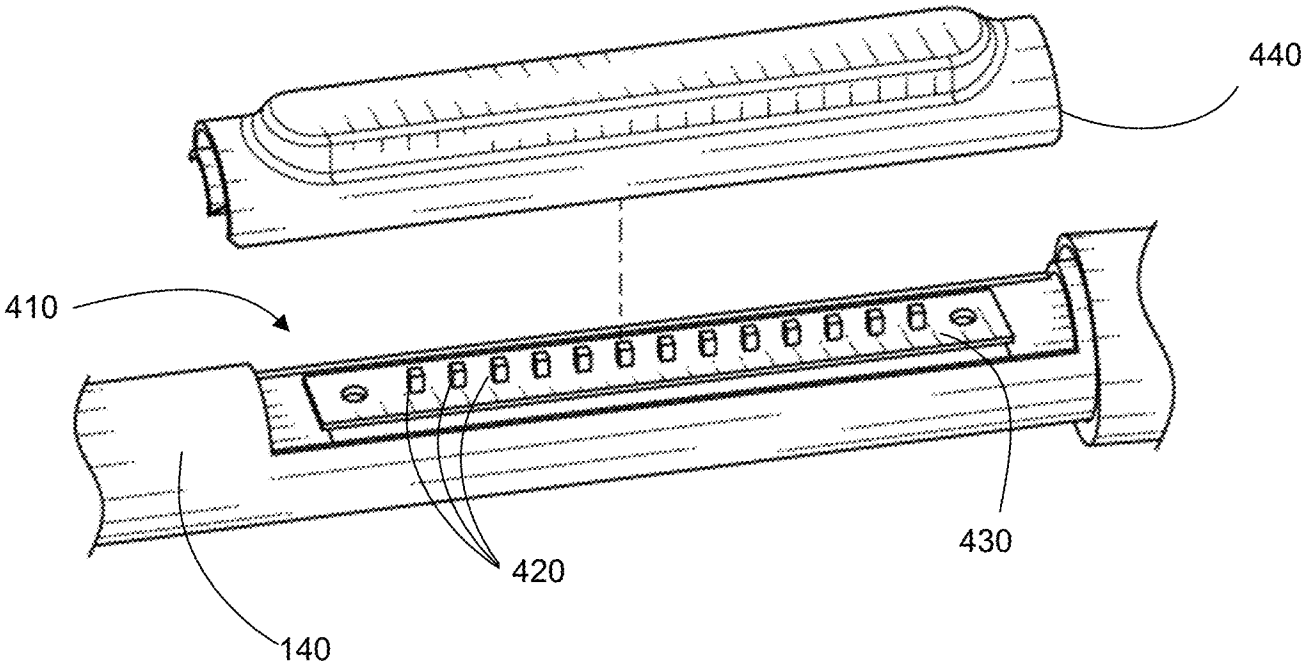
FIG. 4 is perspective view illustrating the illumination system depicted in FIG. 1 according to an example embodiment of the present disclosure.

FIG. 4 depicts an exploded view of the embodiment of the trekking pole 100 shown in FIG. 1 having illumination system 130 positioned within hollow shaft 140. As shown in FIG. 4, substantially hollow shaft 140 may include a cut-out portion 410 within which illumination system 130 may be secured. Illumination system 130 may include one or more illumination source 420 secured to a circuit board 430. Circuit board 430 may comprise a printed circuit board configured to fit within the hollow shaft 140. In other embodiments, circuit board 430 may be a flexible material such as for example a flexible component strip. In some embodiments, circuit board 430 may include a controller and control system for outputting control signals to the one or more illumination sources 420, which may be capable of illuminating light patterns in response to the control signals. In some embodiments, the control signals may be timed to produce predetermined current waveforms at predetermined frequencies or intervals. By way of example and not limitation, exemplary lighting effects may include, but are not limited to, constant on, blinking at predetermined intervals, walking, waterfall, random, or a combination of such effects. For example, the one or more illumination sources 420 may be configured to blink in an SOS pattern in order to indicate that the user of the trekking pole 100 needs assistance.

Further, in some embodiments the circuit board 430 may include user interface controlled by user input. The user interface 540 may include switches or control buttons, such as for example amplitude changing controls, channel changing controls, or frequency changing controls. The switches or control buttons may correspond to various light patterns that may involve, for example, light colors, modulation patterns (e.g., pulsed, triangular, sinusoidal, or rectangular waveforms), light intensities, or light blinking rates. In some embodiments, the circuit board 430 a communications port which may be utilized to send and receive data over a network. Commands and or data sent to the circuit board 430 may, for example, be sent through power line carrier modes, optical (e.g., infrared, visible), sound (e.g., audible, ultrasonic, subsonic modulation), or wireless (e.g., Bluetooth, Zigbee) modes. For example, circuit board 430 may be configured to receive commands from a mobile device, such as for example, a cellular phone of the user.

In some embodiments, the circuit board 430 may include one or more sensors, such as for example, light sensors, gyroscopes, accelerometers, magnetometers, GPS, proximity sensors, etc. In certain embodiments where the trekking pole 100 may include one or more illumination sources 420 oriented in a plurality of directions, such sensors can be utilized by controllers on the circuit board 430 to selectively activate such illumination sources as would be necessary to project light in a desired direction, such as the front facing direction of a user.

In an example implementation, the one or more illumination sources 420 may include LED bulb(s). For example, the one or more illumination sources 420 could include a single colored LED, such as for example a white, or blue LED bulb. As another example, the one or more illumination sources 420 may include RGB LED bulbs, which may include red, green, and blue leds and an embedded integrated circuit (IC) inside each LED lamp. In such an embodiment, the embedded IC can be configured to communicate with and individually control the energizing of each of the corresponding RGB LEDs to create a multitude of different colors and color combinations. In certain example implementations, the embedded IC can be configured to run a pre-programmed sequence for independently energizing the associated LEDs within the illumination source 420 to produce the different colors. According to an example implementation of the disclosed technology, embedded IC within each RGB LED lamp 420 may be configured to initiate and control a sequence of illuminating colors that can vary with time. In certain example implementations, the intensity or brightness of each LED can be individually controlled by the IC. In certain example implementations, the brightness of the LEDs may be controlled by PWM output from the embedded IC. In other example implementations, the color of the lamp 420 may be determined by varying the PWM output from the embedded IC to each LED within the lamp 420.

As further depicted in FIG. 4, circuit board 430 may be secured to cut-out portion 410 and may be covered by a protective cover 440. In some embodiments, the protective cover 440 may comprise a material to allow the passage of light and additionally protect the illumination system from the environment. Suitable examples of such a material can include glass, acrylic, polycarbonate, plexiglass, or any combination thereof. Additionally, the protective cover 440 can comprise a material operable to diffract and/or distribute light from the illumination system. Further, protective cover 440 can serve as to provide insulation and/or weatherproofing for the circuit board 430 and associated components (e.g., illumination sources 420, controller, etc.).

Figure 5:
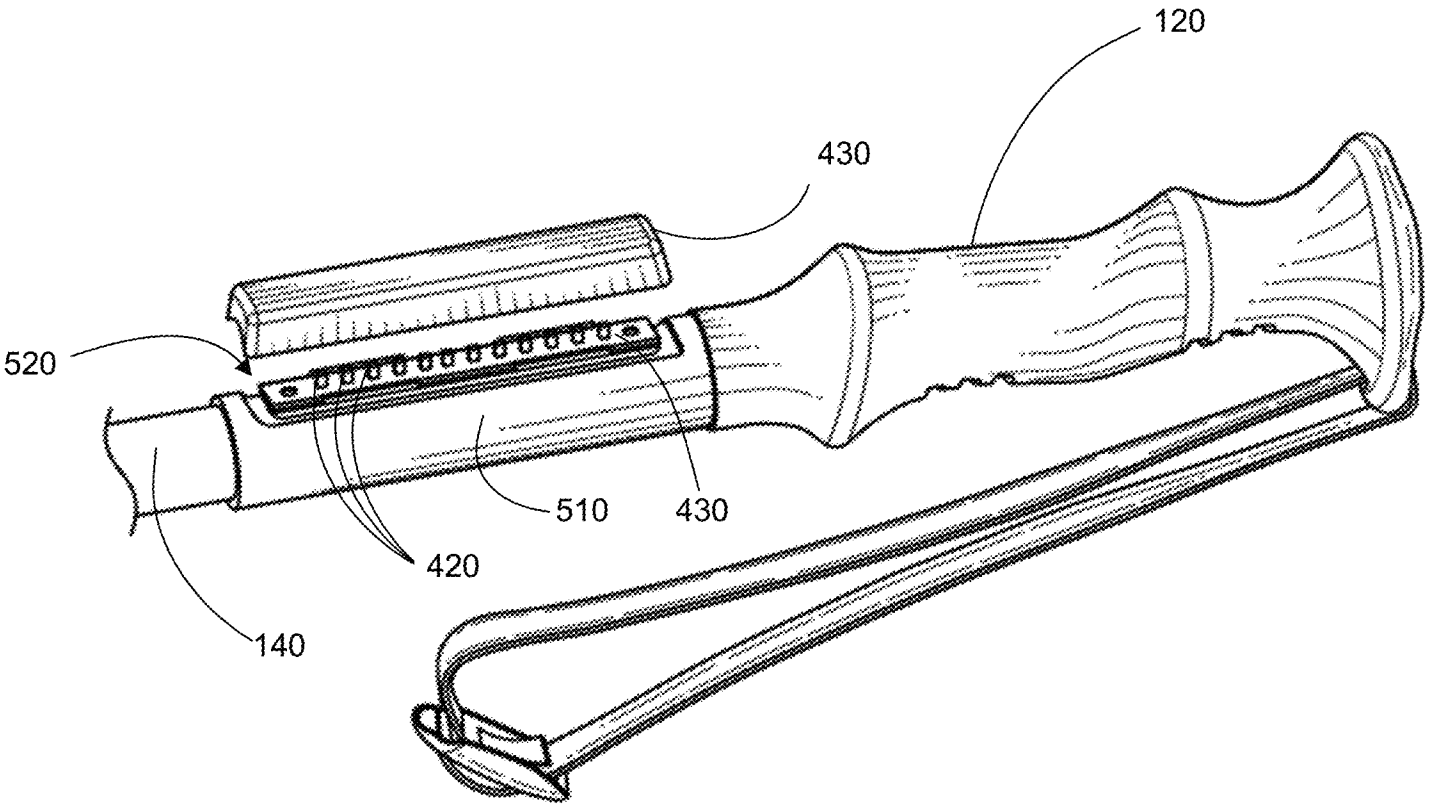
FIG. 5 is a perspective view illustrating the illumination system depicted in FIG. 2 according to an example embodiment of the present disclosure.

FIG. 5 depicts an exemplary embodiment of an illumination system 130 disposed on an exterior surface of the hollow shaft 140. As depicted, illumination system 130 comprises a trunk collar 510, which may attach to the hollow shaft 140 and may include a cutoff portion 520 within which illumination system 130 may be secured. Illumination system 130 may include one or more illumination source 420 secured to a circuit board 430 which may include some or all of the functionality as described above with regard to FIG. 4. As further depicted in FIG. 5, circuit board 430 may be secured to trunk collar 510 and may be covered by a protective cover 440. In some embodiments, the protective cover 440 may comprise a material to allow the passage of light and additionally protect the illumination system from the environment. Suitable examples of such a material can include glass, acrylic, polycarbonate, plexiglass, or any combination thereof. Additionally, the protective cover 440 can comprise a material operable to diffract and/or distribute light from the illumination system. Further, protective cover 440 can serve as to provide insulation and/or weatherproofing for the circuit board 430 and associated components (e.g., illumination sources 420, controller, etc.).

Figure 6:
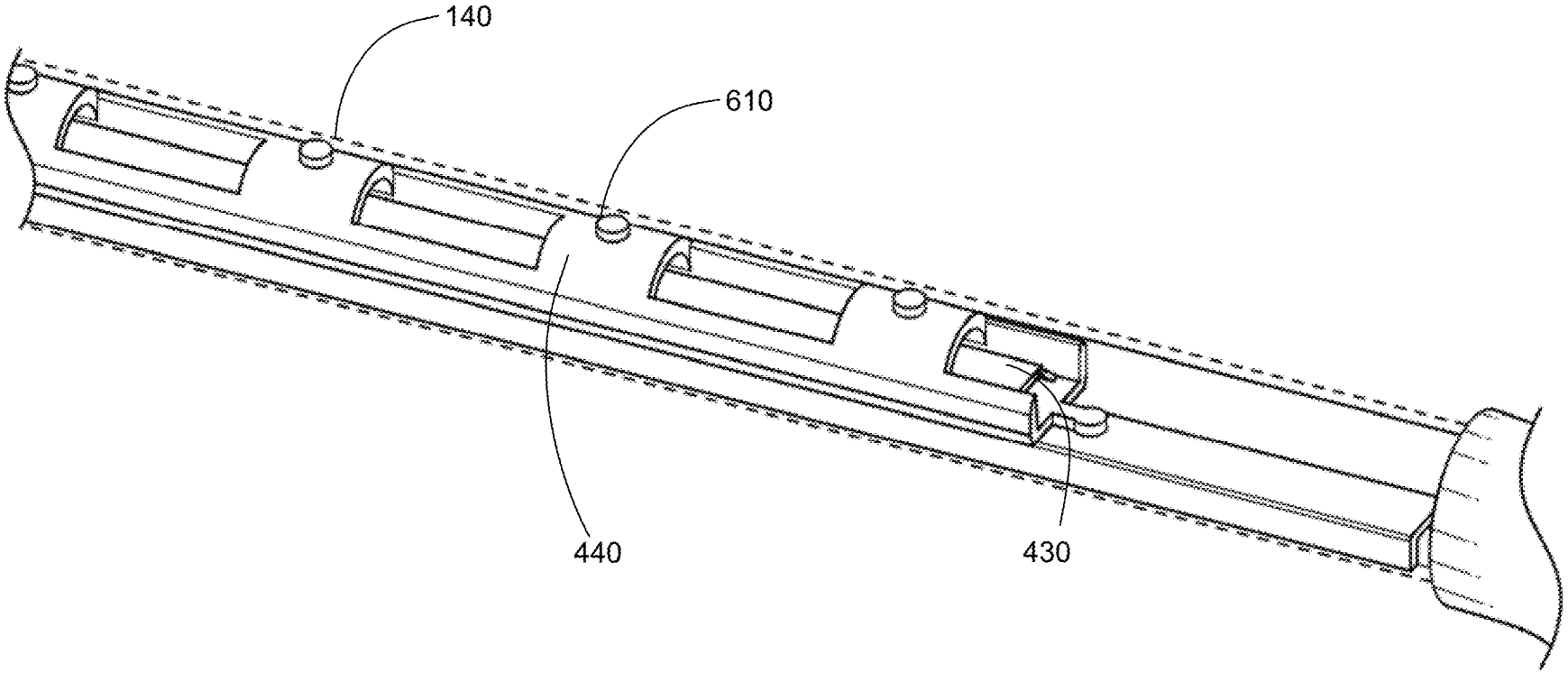
FIG. 6 is a perspective view illustrating the illumination system depicted in FIG. 3 according to an example embodiment of the present disclosure.

FIG. 6 depicts an exemplary embodiment of an illumination system 130 disposed within the hollow shaft 140. As depicted, illumination system 130 may include one or more illumination source 420 (not pictured in FIG. 6) secured to a circuit board 430 which may include some or all of the functionality as described above with regard to FIG. 4. As further depicted in FIG. 6, circuit board 430 may be secured with and may be covered by a protective cover 440. As depicted, protective cover 440 may include one or more raised lens portions 610 which may comprise a material to allow the passage of light and additionally protect the illumination system from the environment. Suitable examples of such a material can include glass, acrylic, polycarbonate, plexiglass, or any combination thereof. Additionally, the protective cover 440 can comprise a material operable to diffract and/or distribute light from the illumination system. Further, protective cover 440 can serve as to provide insulation and/or weatherproofing for the circuit board 430 and associated components (e.g., illumination sources 420, controller, etc.).

Figure 7A:
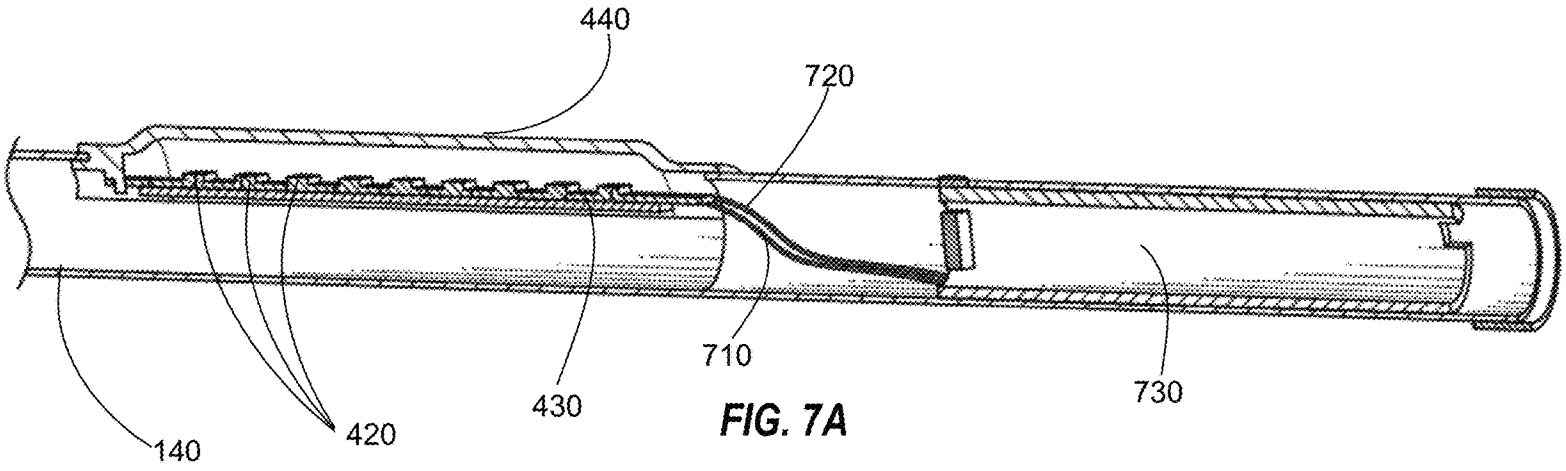
FIG. 7A is a cross sectional view illustrating an illumination system integrated within the substantially hollow shaft, according to an example embodiment of the present disclosure.
Figure 7B:
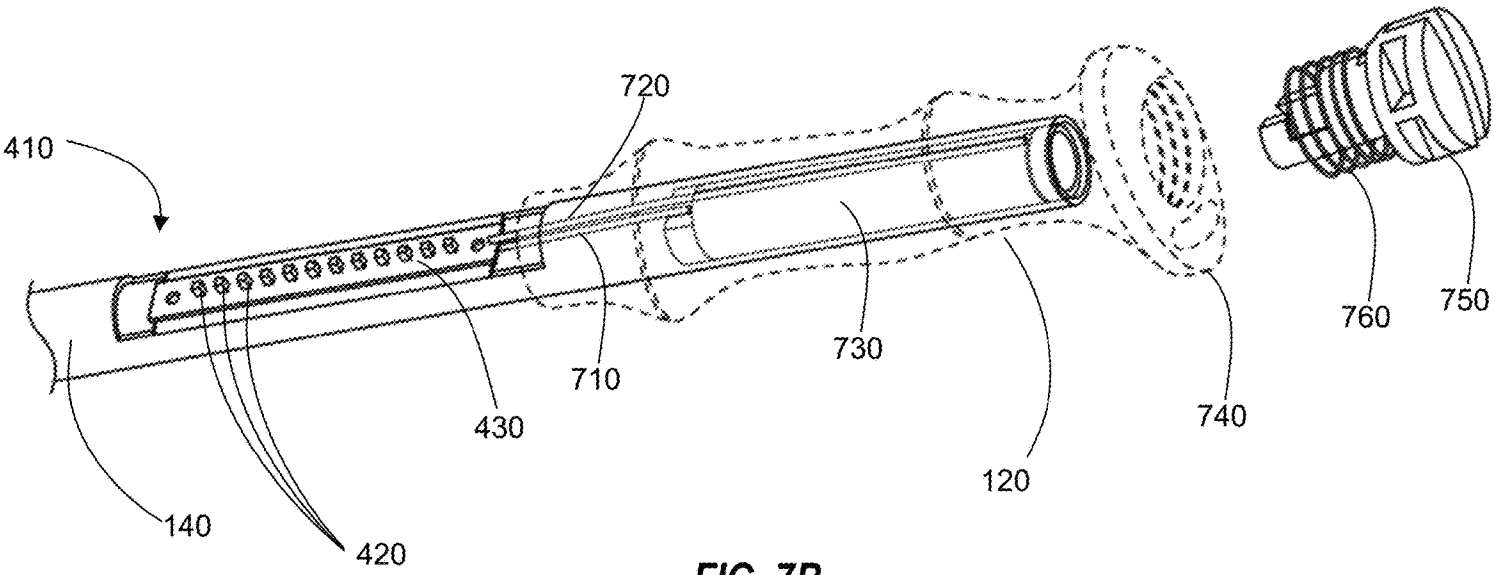
FIG. 7B is a partial cross-sectional view illustrating an illumination system integrated within the substantially hollow shaft, according to an example embodiment of the present disclosure.

FIGS. 7A and 7B depict cutaway views of an assembled trekking pole 100 having illumination system 130 positioned within hollow shaft 140. As shown in FIG. 7A, trekking pole 100 may include a substantially hollow shaft 140 within which illumination system 130 may be secured. Illumination system 130 may include one or more illumination source 420 secured to a circuit board 430. In some embodiments, the circuit board 430 may be configured to receive power from a power source (e.g., batteries, solar power, kinetic power, etc.) via internal electrical conductors 710 and 720. For example, and as depicted, circuit board 430 may be configured to receive power from a power source (e.g., batteries, capacitor bank, etc.) located with power source housing 730 via internal electrical conductors 710 and 720. In some embodiments, the internal electrical conductors 720 and 730 can be insulated copper wire or exposed copper wire. As depicted, power source housing 730 may be at least partially contained within the hollow shaft 140. As would be appreciated by one of ordinary skill in the art, such an embodiment comprising a substantially cylindrical power source housing can allow for use of a battery as the power source.

FIG. 7B depicts a similar embodiment to that shown in FIG. 7A, however FIG. 7B additionally depicts handle assembly 120. As depicted handle assembly 120 includes a handle grip 740 and power source housing cover 750. As shown, handle grip 740 may have an inner diameter larger than the outer diameter of the hollow shaft 140 and may be configured to attach to hollow shaft 140. Further, power source housing cover 750 may be configured to removably attach to the handle grip 740 such that a power source may be replaceably secured within the power source housing 730. For example, power source housing cover 750 may comprise threads that are configured to mate with associated threads within an opening of handle grip 740. As further depicted in FIG. 7B, power source housing cover 750 may be spring loaded such that the power source may be selectively engageable by a user. For example, power source housing cover 750 may include a spring 760 operable to expand and be contracted based on user input (e.g., pushing the power source housing cover 750 down into the opening of handle grip 740). As previously discuss, illumination system 130 may include multiple different lighting settings, and such a spring-loaded housing cover 750 may allow a user to alternate between the various settings.

Figure 8B:
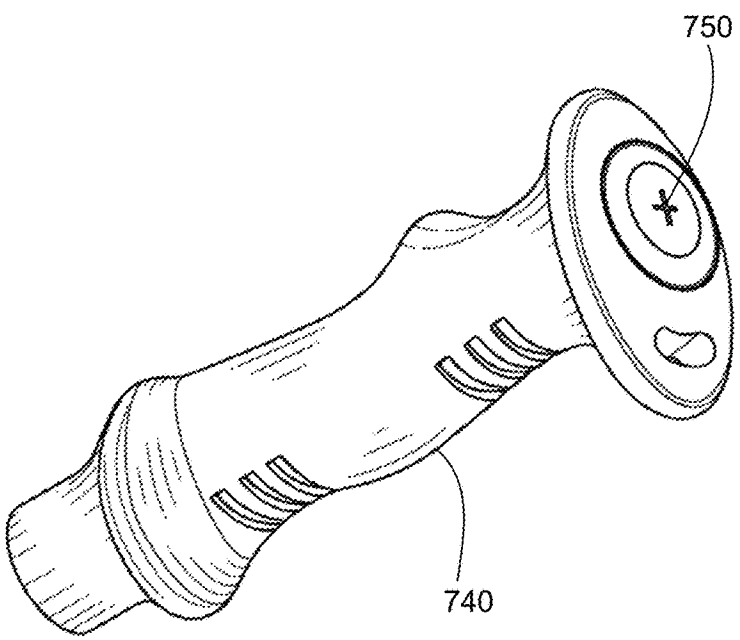
FIG. 8B is a perspective view illustrating an assembled grip handle, according to an example embodiment of the present disclosure.
Figure 8A:
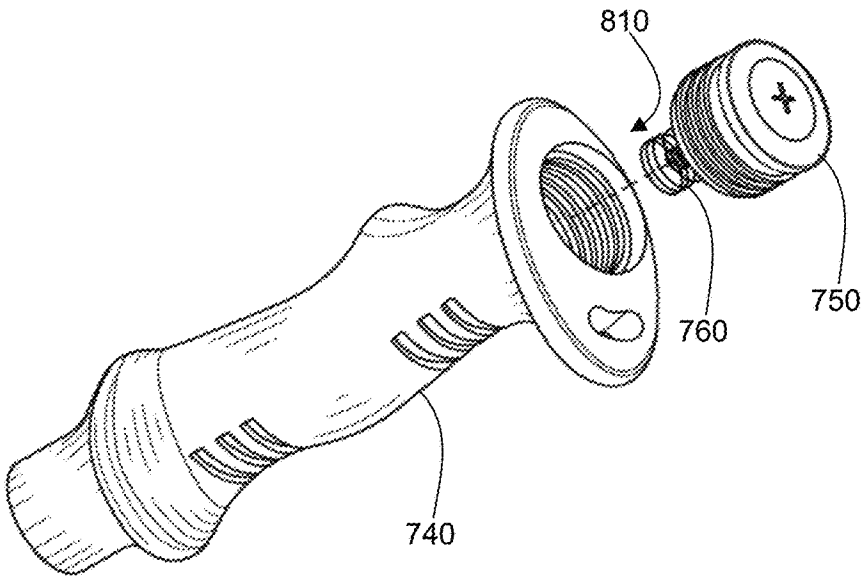
FIG. 8A is an exploded view illustrating a grip handle assembly, according to an example embodiment of the present disclosure.

FIG. 8A depicts an exploded view of grip handle 740 with removably attachable power source housing cover 750. As previously discussed with reference to FIG. 7B and further depicted in FIG. 8A, power source housing cover 750 may comprise threads that are configured to mate with associated threads within an opening 810 of handle grip 740. Further, FIG. 8A depicts power source housing cover 750 including a spring 760 operable to expand and be contracted based on user input. FIG. 8B depicts grip handle 740 having power source housing cover 750 inserted into the opening 810.

Figure 9A:
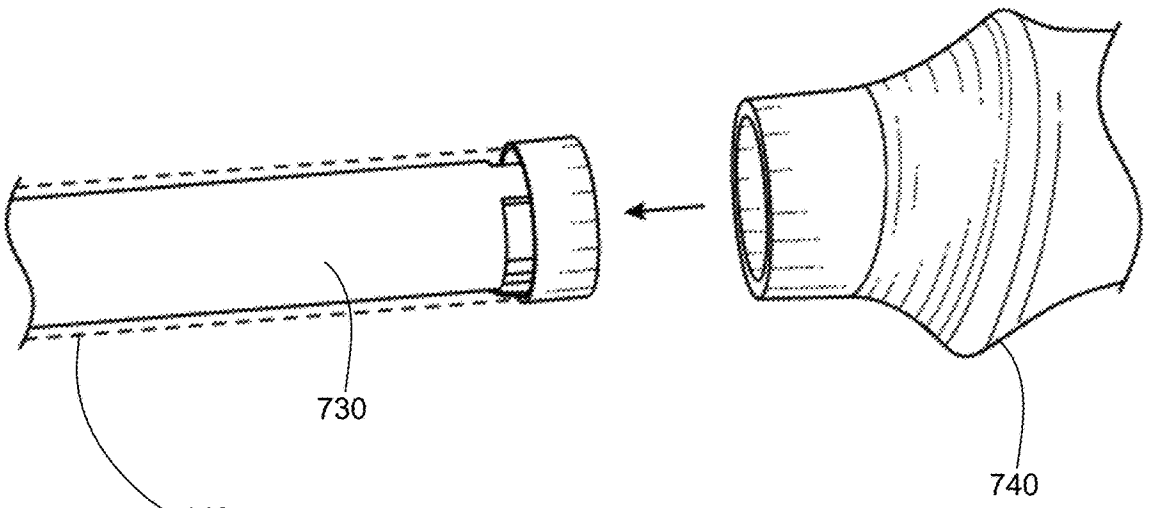
FIG. 9A is an exploded view illustrating a grip handle configured to attach to a substantially hollow shaft, according to an example embodiment of the present disclosure.

FIG. 9A depicts an exemplary embodiment of a grip handle 740 configured to detachably attach to the hollow shaft 140 and at least partially contain the power source housing 730. In certain embodiments, the grip handle 740 may comprise a material to confer desirable properties for the user during use. For example, the grip handle 740 may comprise a rubber material to improve grip during use. Further, grip handle 740 may comprise polypropylene for rigidity. Additionally, multiple grip handles 740 comprising different materials may be provided in order for the user to detachably attach a preferred grip handle 740 based on certain situations and uses. In some embodiments, the grip handle 740 may have raised portions or ribbed portions to assist in improving grip ability and grip comfort during use.

Figure 9B:
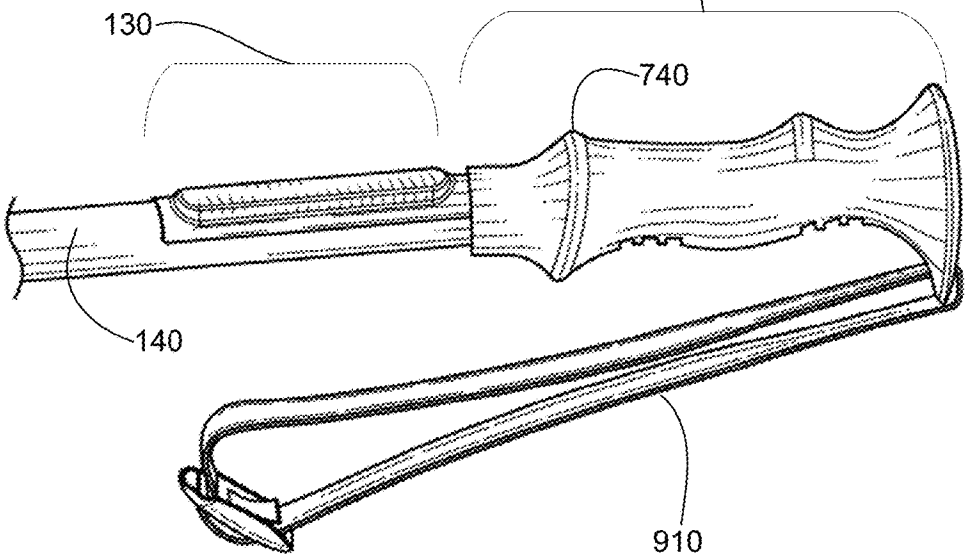
FIG. 9B is a perspective view illustrating a grip handle including an adjustable strap fastening device attached to a substantially hollow shaft, according to an example embodiment of the present disclosure.

FIG. 9B depicts an assembled trekking pole 100 having illumination system 130 positioned within hollow shaft 140 and having handle assembly 120 attached to hollow shaft 140. As depicted, grip handle 740 comprises an adjustable strap 910. As would be appreciated by one of ordinary skill in the art, such an embodiment would provide an adjustable loop affixed to the grip handle such that the user could fix the strap securely to a wrist or other body part during use. Suitable examples for a material making up the strap 910 can include polyester fibers, polyethylene yarn, a combination thereof, or any other material suitable as known by one of ordinary skill in the art.

Figure 10:
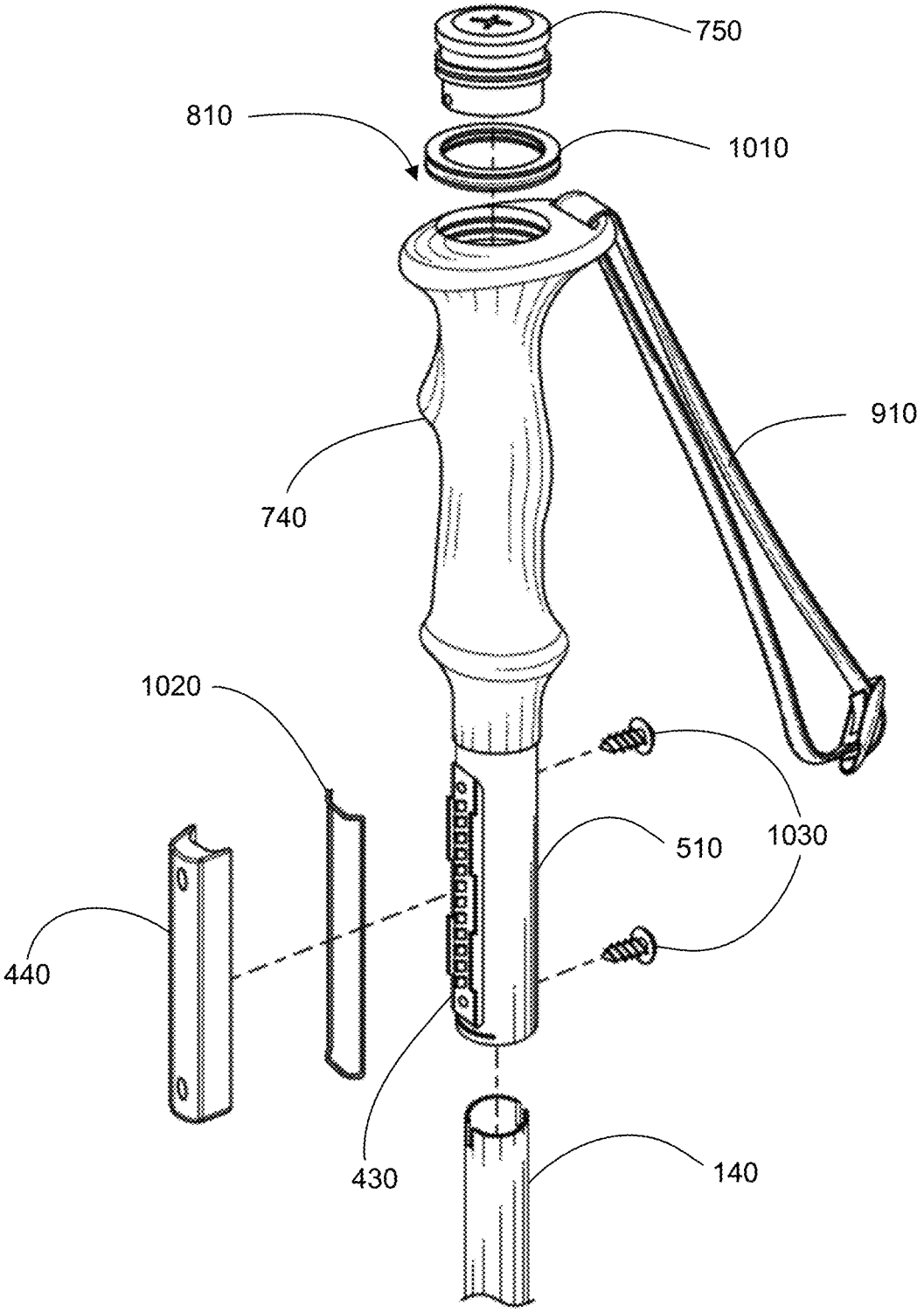
FIG. 10 is an exploded view illustrating a weatherproof illuminated trekking pole assembly, according to an example embodiment of the present disclosure.

FIG. 10 depicts an exploded view of a trekking pole 100, according to an example embodiment. As shown, trekking pole 100 may include a substantially hollow shaft 140 upon which illumination system 130 may be secured. Illumination system 130 may include a circuit board 430 comprising one or more illumination sources 420. As further depicted in FIG. 10, circuit board 430 may be secured to trunk collar 510 via attachment mechanisms 1030 and may be covered by a protective cover 440. Further, a seal gasket 1020 may be inserted between circuit board 430 and protective cover 440. In some embodiments, seal gasket 1020 may be made of a rubber like material such as, for example, TPR, TPU, Silicon rubber, or any other suitable material. As will be appreciated, such an embodiment provides the for a seal to help prevent water from entering the area where the electrical components are housed. Additionally, in some embodiments, circuit board 430 may include a water proof coating.

FIG. 10 further depicts trekking pole 100 including a grip handle 740 and power source housing cover 750. As shown, a seal gasket 1010 may be inserted between power source housing cover 750 and grip handle 740. In some embodiments, seal gasket 1010 may be made of a rubber like material such as, for example, TPR, TPU, Silicon rubber, or any other suitable material. As will be appreciated, such an embodiment provides the for a seal to help prevent water from entering the area where the power source may be housed.

Figure 11A:
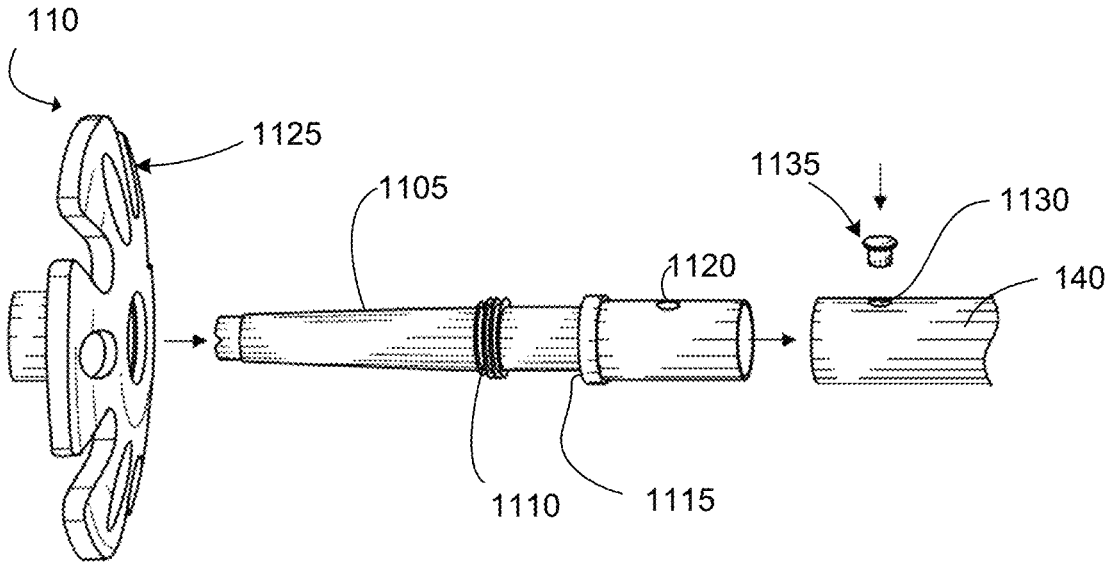
FIG. 11A is an exploded view of the pole tip, basket, and substantially hollow shaft according to an example embodiment of the present disclosure.

FIG. 11A depicts an exploded view of the pole tip assembly 110 according to an example embodiment of the present disclosure. As shown, pole tip assembly 110 comprises a tip member 1105 including a threading 1110, a stopping flange 1115, and a securing mechanism 1120, a basket 1125 and a securing device 1135. In some embodiments, tip member 1105 may be detachably connected to hollow shaft 140. For example, securing device 1135 may be configured to be inserted through hollow shaft securing mechanism 1130 and securing mechanism 1120. The securing device 1135 can be any fixable device operable to detachably attach to the hollow shaft 140 and the tip member 1105. As will be appreciated by one of skill, such an embodiment allows for flexibility in terms of the types of terrains the trekking pole may be used for. For example, a tip member 1105 may be attached that is designed for snow if a user desires to ski, while a tip member 1105 designed for rocky terrain may be attached if a user desires to go hiking.

Figure 11B:
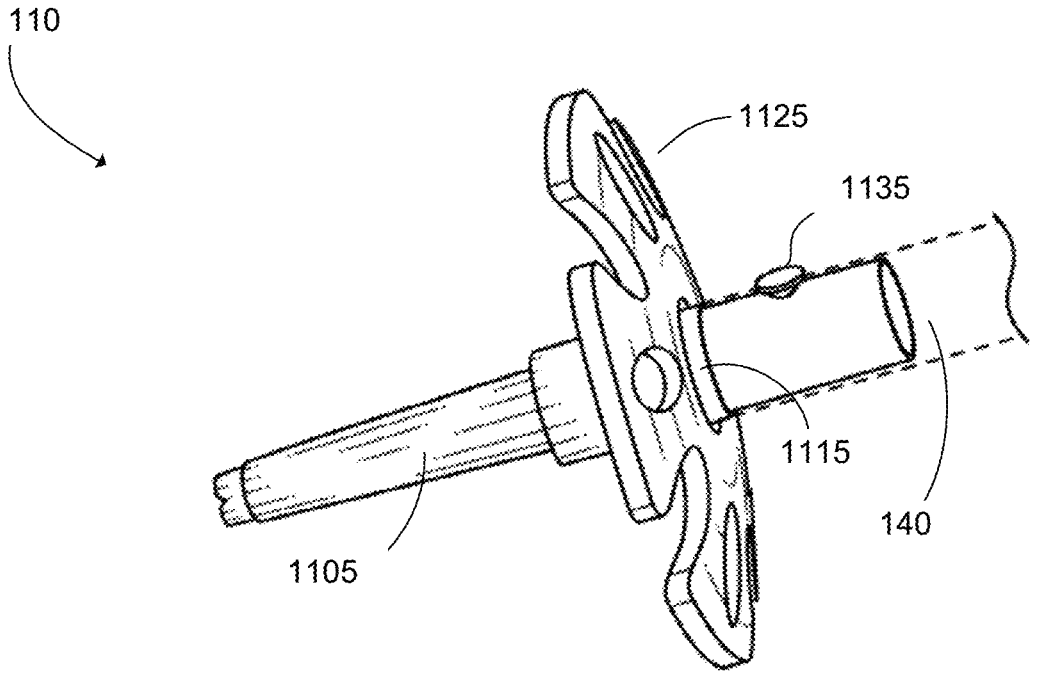
FIG. 11B is a perspective view of the assembled pole tip, basket, and substantially hollow shaft according to an example embodiment of the present disclosure.

As further depicted in FIG. 11A, pole tip assembly 110 may include a basket 1125 configured to attach to the tip member 1105 via threading 1110 and stopping flange 1115. In other embodiments, the basket 1125 can attach to the tip member 1105 by other fastening means such as rivets, pins, screws, or other methods obvious to one of ordinary skill in the art. In some additional embodiments, basket 1125 may comprise one or more illumination sources 420. As will be appreciated, such an embodiment provides additional potential illumination. As would be appreciated by one of ordinary skill in the art, the basket 1125 size and material can be selected based on the intended use for the apparatus. For example, a larger basket can be used fluffy snow to prevent the apparatus from falling too deep into the snow. Alternatively, smaller baskets can be attached for use in hard-packed snow or in hiking terrain. In some embodiments, multiple baskets can be provided and detachably attached by the user depending on the situation. FIG. 11B is a perspective view of the assembled pole tip assembly 120. As shown, securing device 1135 may be utilized to secure tip member 1105 to hollow shaft 140 and basket 1125 may be secured to tip member 1105.

Figure 12A:
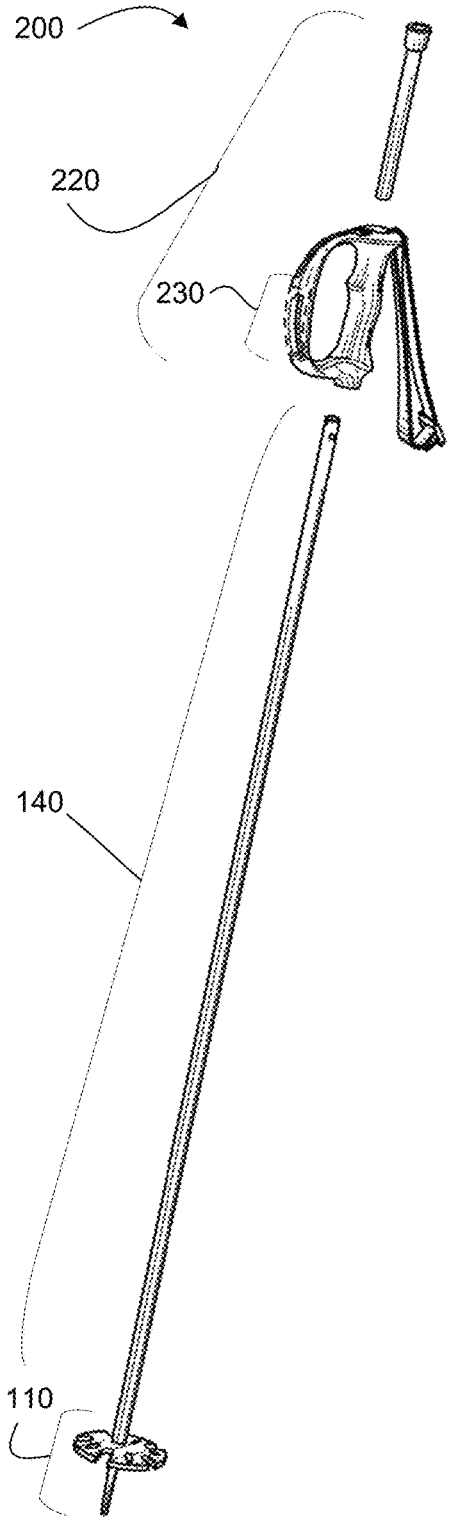
FIG. 12A is an exploded view illustrating an illuminated trekking pole assembly wherein the illumination system is integrated into the grip handle assembly, according to an example embodiment of the present disclosure.
Figure 12B:
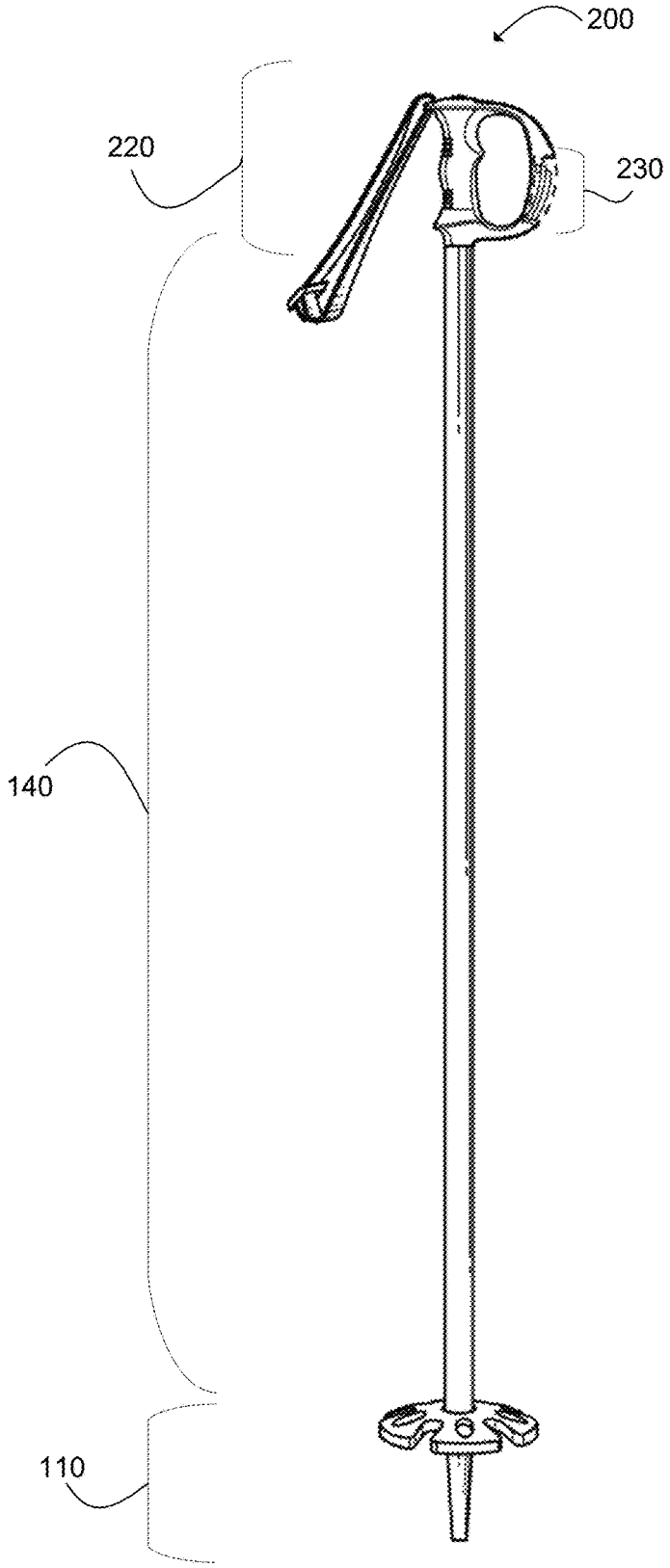
FIG. 12B is a perspective view illustrating an assembled illuminated trekking pole wherein the illumination system is integrated into the grip handle assembly, according to an example embodiment of the present disclosure.

FIGS. 12A and 12B depict an exemplary embodiment of an illuminated trekking pole 200. FIG. 12A depicts an exploded view, while FIG. 12B depicts an assembled view. In some embodiments, the illuminated handheld support apparatus 200 may comprise a substantially hollow shaft 140, a shaft tip assembly 110, a handle assembly 220, and an illumination system 230. As shown, the illumination system 230 may be at least partially integrated with within the handle assembly 220. The substantially hollow shaft 140 can connect to the shaft tip assembly 110 at one end and the handle assembly 220 at the other. In some embodiments, the illumination system 230, the shaft tip assembly 110, and the handle assembly 220 can be configured to detachably attach to the hollow shaft 140. As will be appreciated, such an embodiment allows for ease of transport of the illuminated trekking pole 200 by reducing the overall product length during transport among other previously discussed benefits. Further, in some embodiments, the hollow shaft 104 may comprise grooves operable to rotationally lock the handle assembly 220 to a predetermined and fixed position. As would be appreciated by one of ordinary skill in the art, such an embodiment would prevent movement and/or rotation of the grip handle during vigorous use.

Figures 13A, 13B:
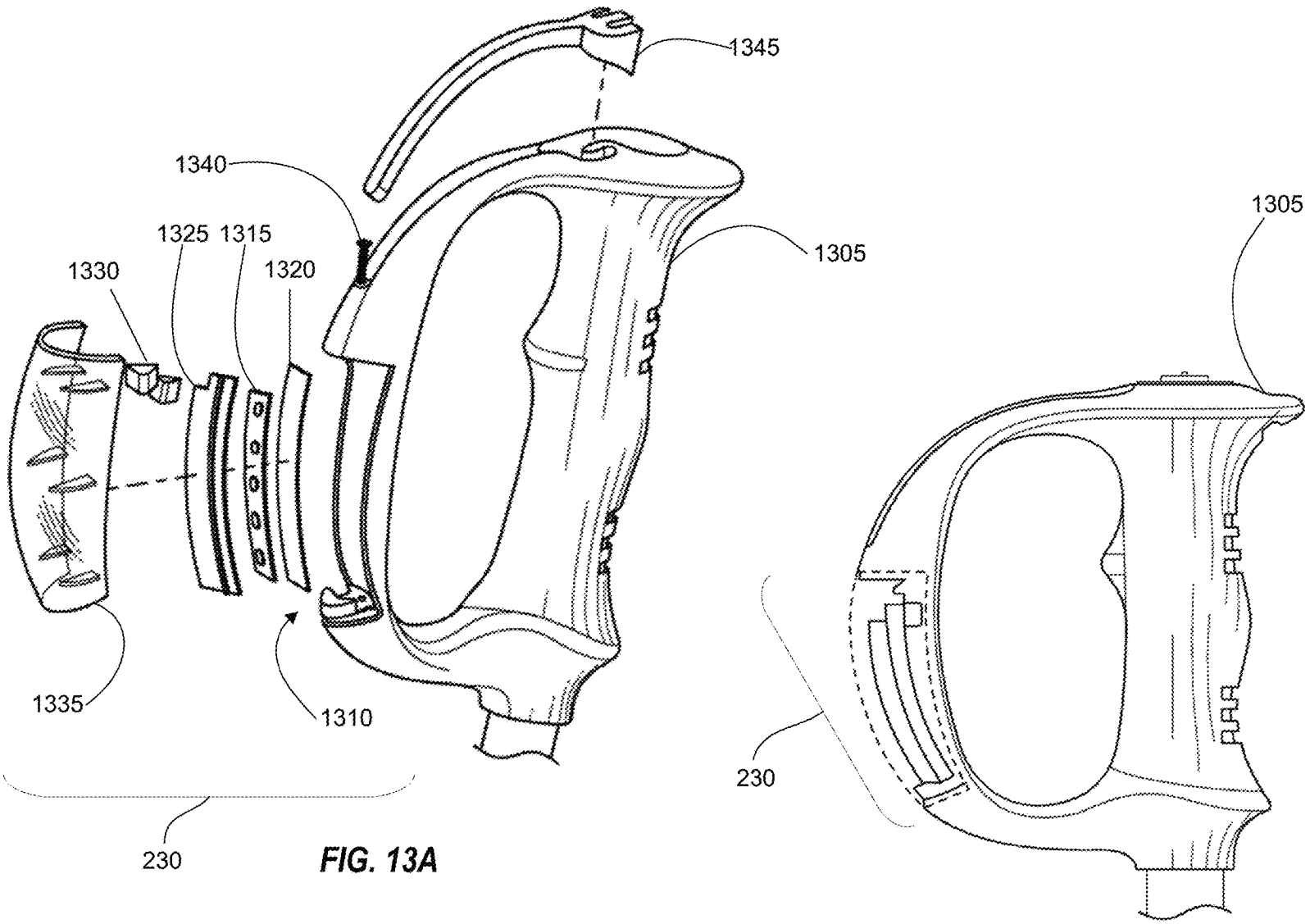
FIG. 13A is an exploded view illustrating a grip handle assembly having an illumination system integrated therein, according to an example embodiment of the present disclosure.
FIG. 13B is a perspective view illustrating an assembled grip handle having an illumination system integrated therein, according to an example embodiment of the present disclosure.

FIGS. 13A and 13B depict an exemplary embodiment of a handle assembly 220. FIG. 13A depicts an exploded view, while FIG. 13B depicts an assembled view. In some embodiments, the handle assembly 220 may comprise a grip handle 1305, a cut-out portion 1310 within which illumination system 230 may be secured, a complementary part 1345, and a securing device 1340. As further depicted, illumination system 230 may comprise one or more light sources secured to a circuit board 1315, a light source cover 1335, and a securing device 1340. In some embodiments, illumination system 230 may further comprise a heat dissipation device 1320, a lens 1325, and lens holder 1330.

Circuit board 1315 may comprise a printed circuit board configured to fit within the cut-out portion 1310 of the grip handle 1305. In other embodiments, circuit board 1315 may be a flexible material such as for example a flexible component strip. In some embodiments, circuit board 1315 may include a controller and control system for outputting control signals to the one or more light sources, which may be capable of illuminating light patterns in response to the control signals. In some embodiments, the control signals may be timed to produce predetermined current waveforms at predetermined frequencies or intervals. By way of example and not limitation, exemplary lighting effects may include, but are not limited to, constant on, blinking at predetermined intervals, walking, waterfall, random, or a combination of such effects. For example, the one or more light sources may be configured to blink in an SOS pattern in order to indicate that the user of the trekking pole 100 needs assistance.

As further depicted in FIGS. 13A and 13B, circuit board 1315 may be secured to cut-out portion 1310 and may be covered by a protective cover 1335. In some embodiments, the protective cover 1335 may comprise a material to allow the passage of light and additionally protect the illumination system from the environment. Suitable examples of such a material can include glass, acrylic, polycarbonate, plexiglass, or any combination thereof. Additionally, the protective cover 1335 can comprise a material operable to diffract and/or distribute light from the illumination system. Further, protective cover 1335 can serve as to provide insulation and/or weatherproofing for the circuit board 1315 and associated components (e.g., illumination sources, controller, etc.).

Figure 14:
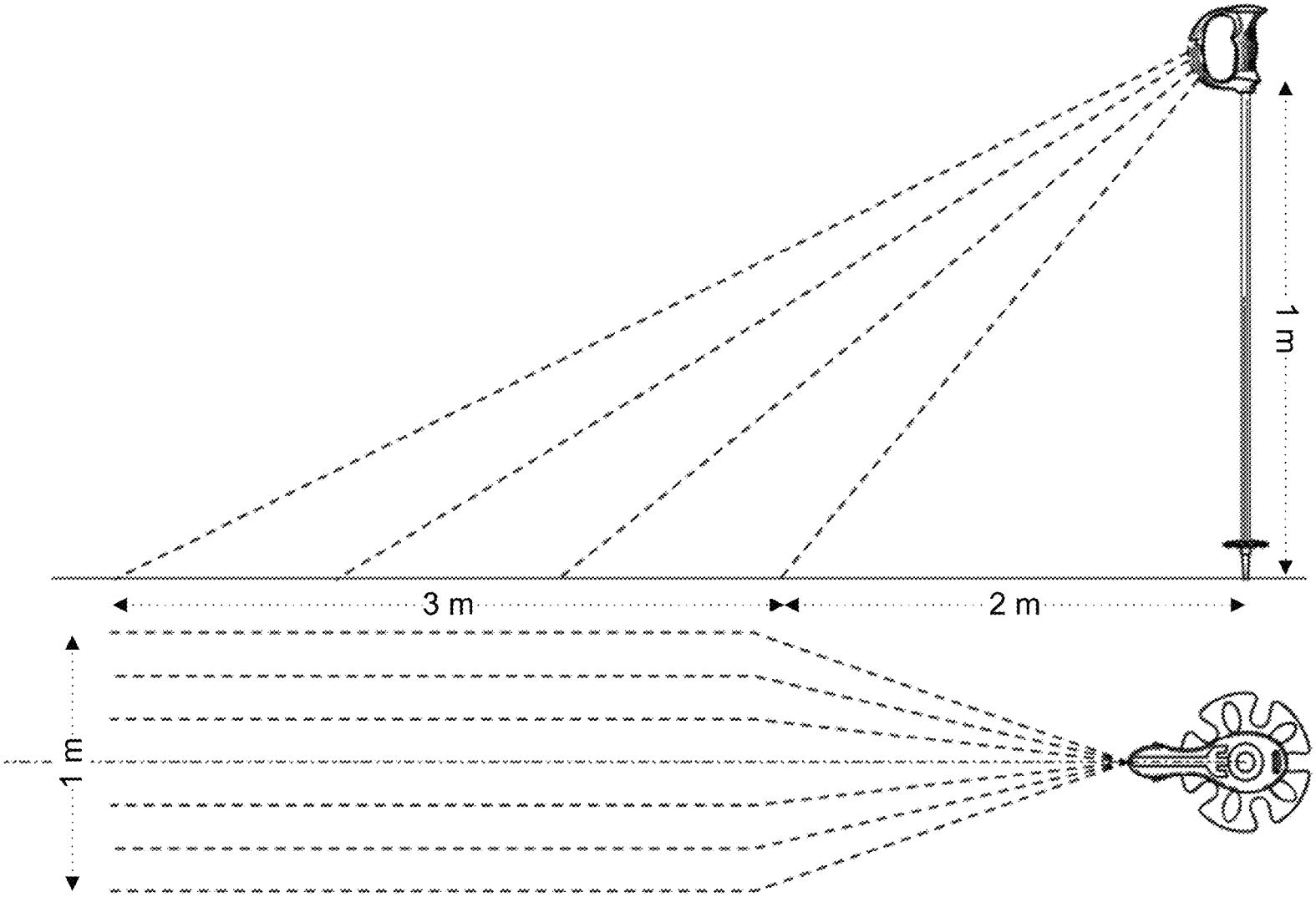
FIG. 14 depicts perspective views illustrating the illumination effect produced by the illumination system depicted in FIGS. 13A and 13B, according to an example embodiment of the present disclosure.

FIGS. 14A and 14B depict perspective views illustrating the illumination effect produced by the illumination system depicted in FIGS. 13A and 13B, according to an example embodiment of the present disclosure. As shown in FIG. 14A, when the trekking pole 200 is in a vertical position, the produced illumination may extend up to 2.5 meters with full intensity. As further shown, when the trekking pole 200 is in a vertical position, the produced illumination may extend up to 3.5 meters with at least partial luminescence. FIG. 14B depicts the lighting width across a similar length axis as in FIG. 14A. As shown, when the trekking pole 200 is in a vertical position, the produced illumination may beyond 1 meter in width. As will be appreciated, such dimensions of the dispersed light provide a user with a well lit pathway when utilizing the disclosed lighted trekking pole 200.

Figure 15:
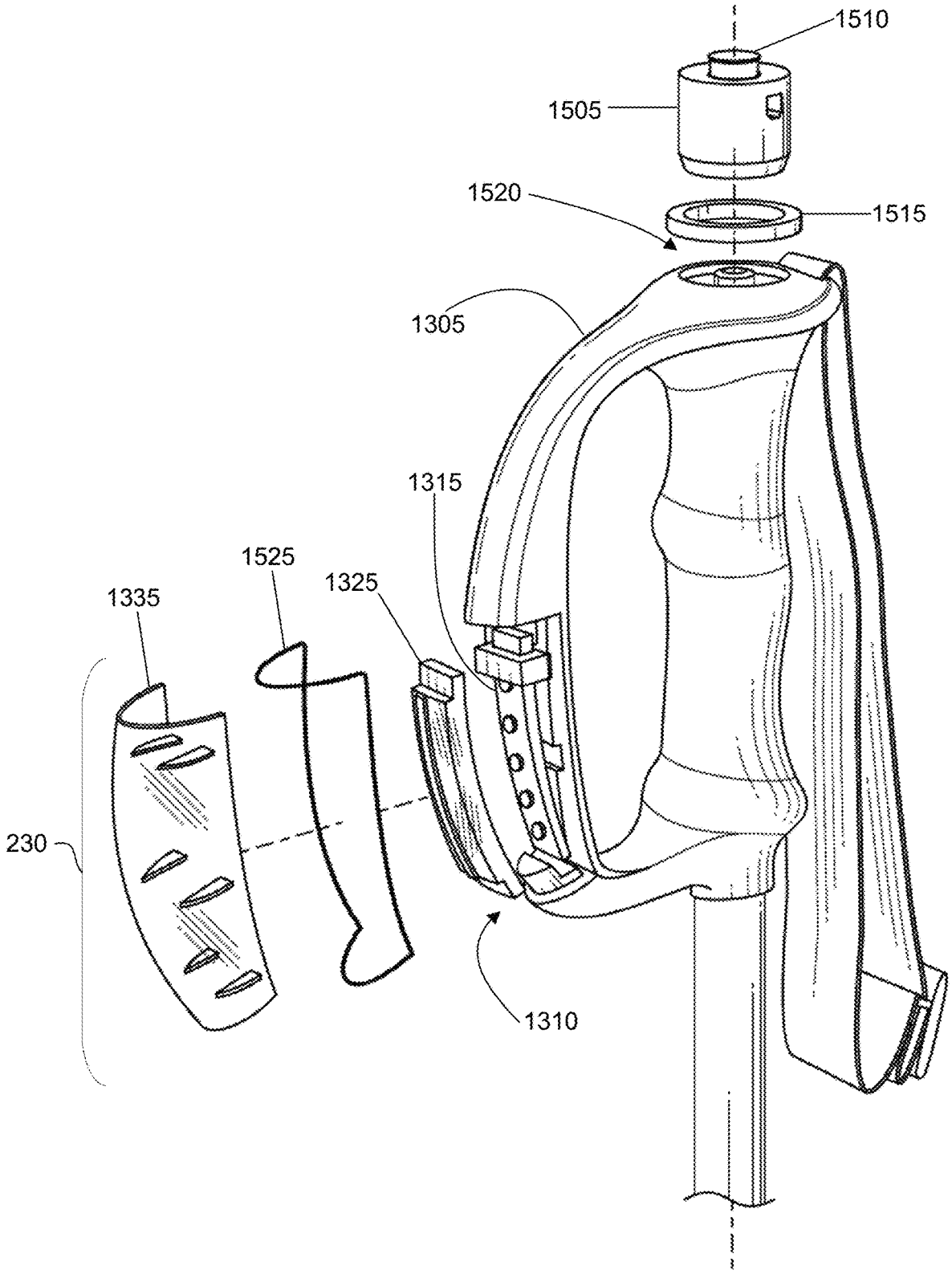
FIG. 15 is an exploded view illustrating a weatherproof illuminated trekking pole assembly, according to an example embodiment of the present disclosure.

FIG. 15 further depicts trekking pole 200 including a grip handle 1305 and power source housing cover 1505. As shown, power source housing cover 1505 may be configured to removably attach to the handle grip 1305 such that a power source may be replaceably secured within the opening 1520 of the handle grip 1305. As further depicted in FIG. 15, power source housing cover 1505 may include a user input device 1510 configured to be selectively engageable by a user. For example, power source housing cover 1505 may include a button 1510 to be engaged and disengaged based on user input (e.g., pushing button 1510 down into the opening 1520 of handle grip 1305). As previously discuss, illumination system 230 may include multiple different lighting settings, and such button 1510 may allow a user to alternate between the various settings.

Additionally, as shown in FIG. 15, a seal gasket 1515 may be inserted between power source housing cover 1505 and grip handle 1305. In some embodiments, seal gasket 1515 may be made of a rubber like material such as, for example, TPR, TPU, Silicon rubber, or any other suitable material. As will be appreciated, such an embodiment provides the for a seal to help prevent water from entering the area where the power source may be housed.

As further depicted in FIG. 15, circuit board 1315 may be secured handle grip 1305 via a locking protective cover 1335. For example, locking protective cover 1335 may be configured to snap on to a portion of the cut-out portion 1310 of the grip handle 1305. Further, a seal gasket 1525 may be inserted between circuit board 1315 and protective cover 1335. In some embodiments, seal gasket 1525 may be made of a rubber like material such as, for example, TPR, TPU, Silicon rubber, or any other suitable material. As will be appreciated, such an embodiment provides the for a seal to help prevent water from entering the area where the electrical components are housed. Additionally, in some embodiments, circuit board 1315 may include a water proof coating.

Figure 16B:
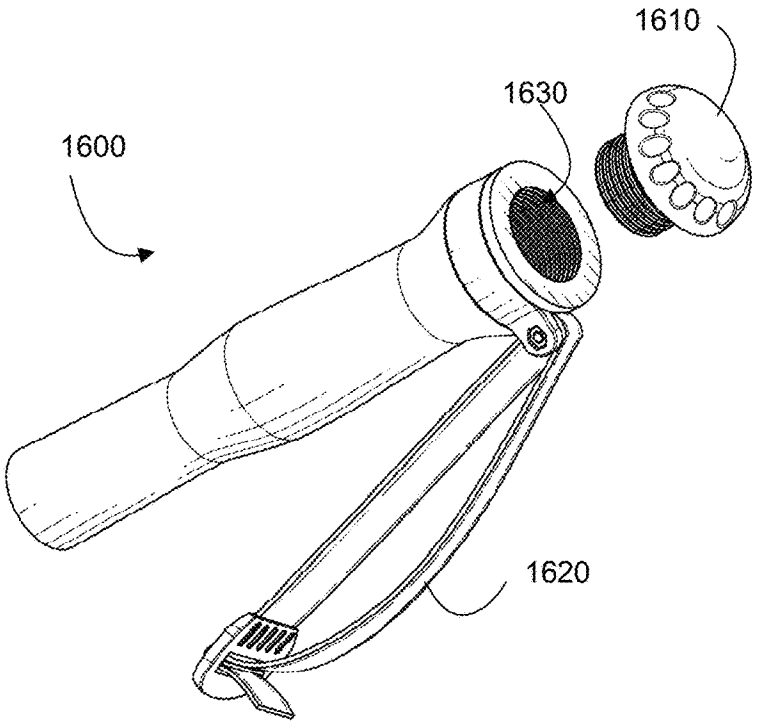
FIG. 16B is an exploded view illustrating a grip handle assembly, according to an example embodiment of the present disclosure.
Figure 16A:
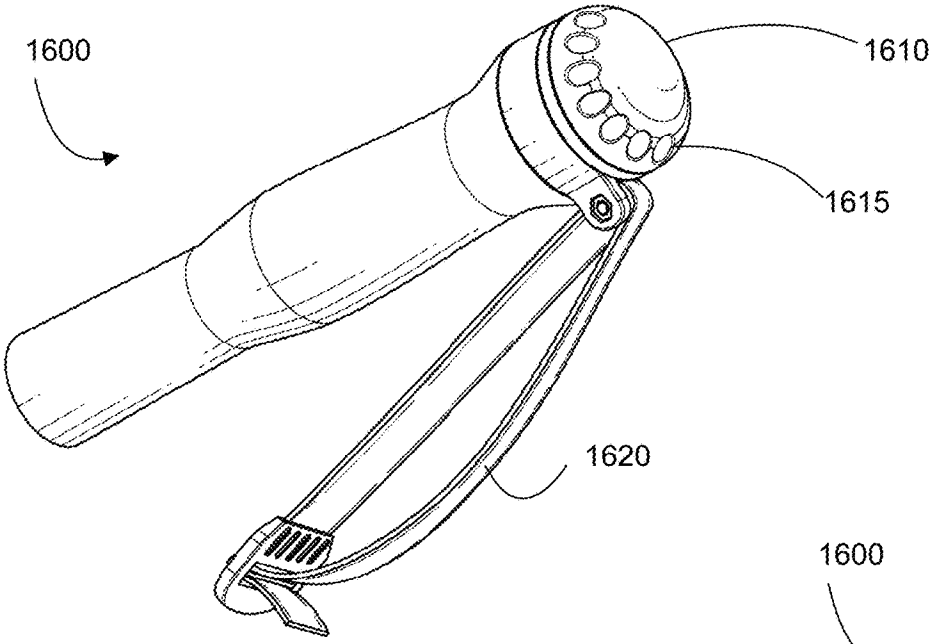
FIG. 16A is a perspective view illustrating an assembled grip handle, according to an example embodiment of the present disclosure.

FIG. 16A depicts a perspective view of an assembled grip handle 1600 with removably attachable power source housing cover 1610 and adjustable strap 1620. Grip handle 1600 may be configured to detachably attach to substantially hollow shaft 140. Further, removably attachable power source housing cover 1610 may include one or more gripping members 1615. For example, gripping members 1615 may be cylindrically spaced about the removably attachable power source housing cover 1610 and may facilitate the removal of removably attachable power source housing cover 1610 from grip handle 1600. FIG. 16B depicts an exploded view of grip handle 1600 with removably attachable power source housing cover 1610 and adjustable strap 1620. As previously discussed with reference to FIG. 7B and FIG. 8A, power source housing cover 1610 may comprise threads that are configured to mate with associated threads within an opening 1630 of grip handle 1600. Further, power source housing cover 1610 may be spring loaded such that the power source may be selectively engageable by a user. For example, power source housing cover 1610 may include a spring operable to expand and be contracted based on user input (e.g., pushing the power source housing cover 1610 down into the opening of handle grip 1630).

Figure 17B:
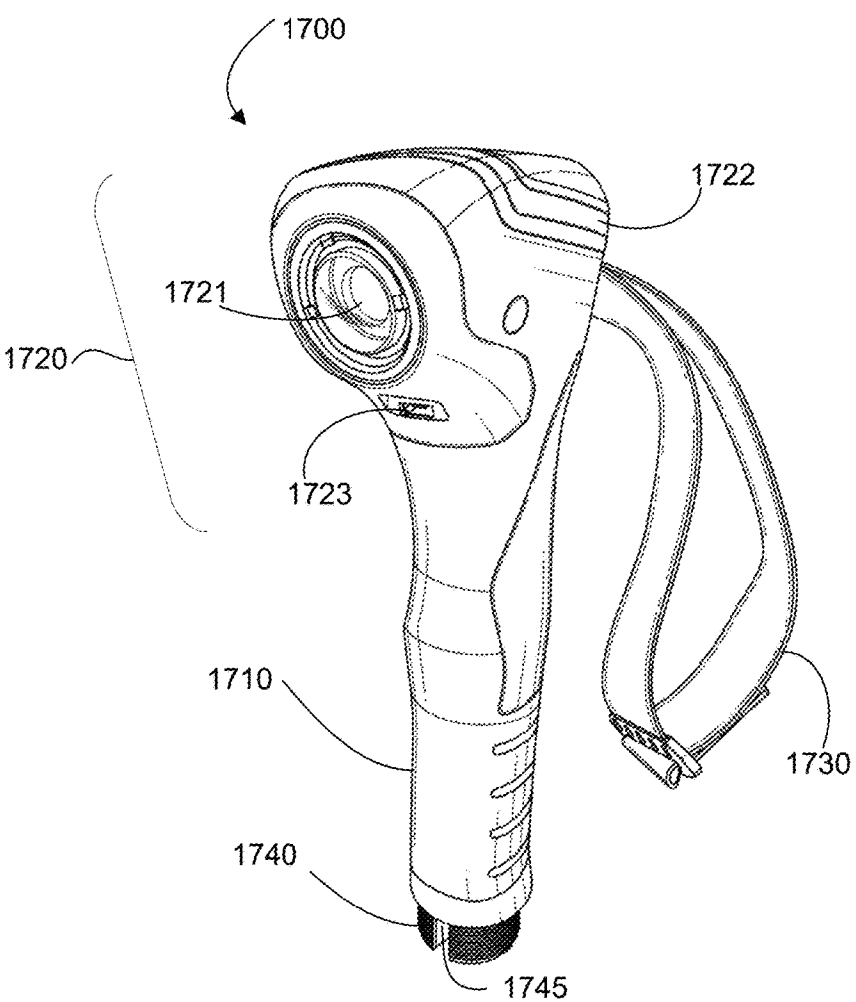
FIGS. 17A, 17B, and 17C are perspective views illustrating an assembled grip handle having an illumination system integrated therein, according to an example embodiment of the present disclosure.
Figure 17A:
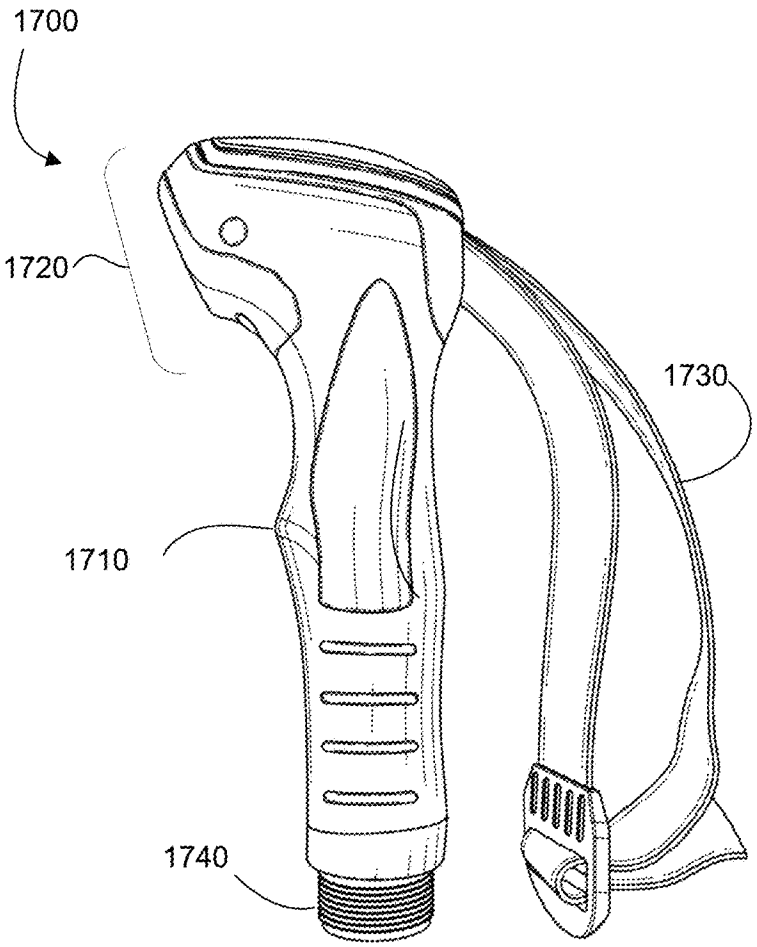
Figure 17C:
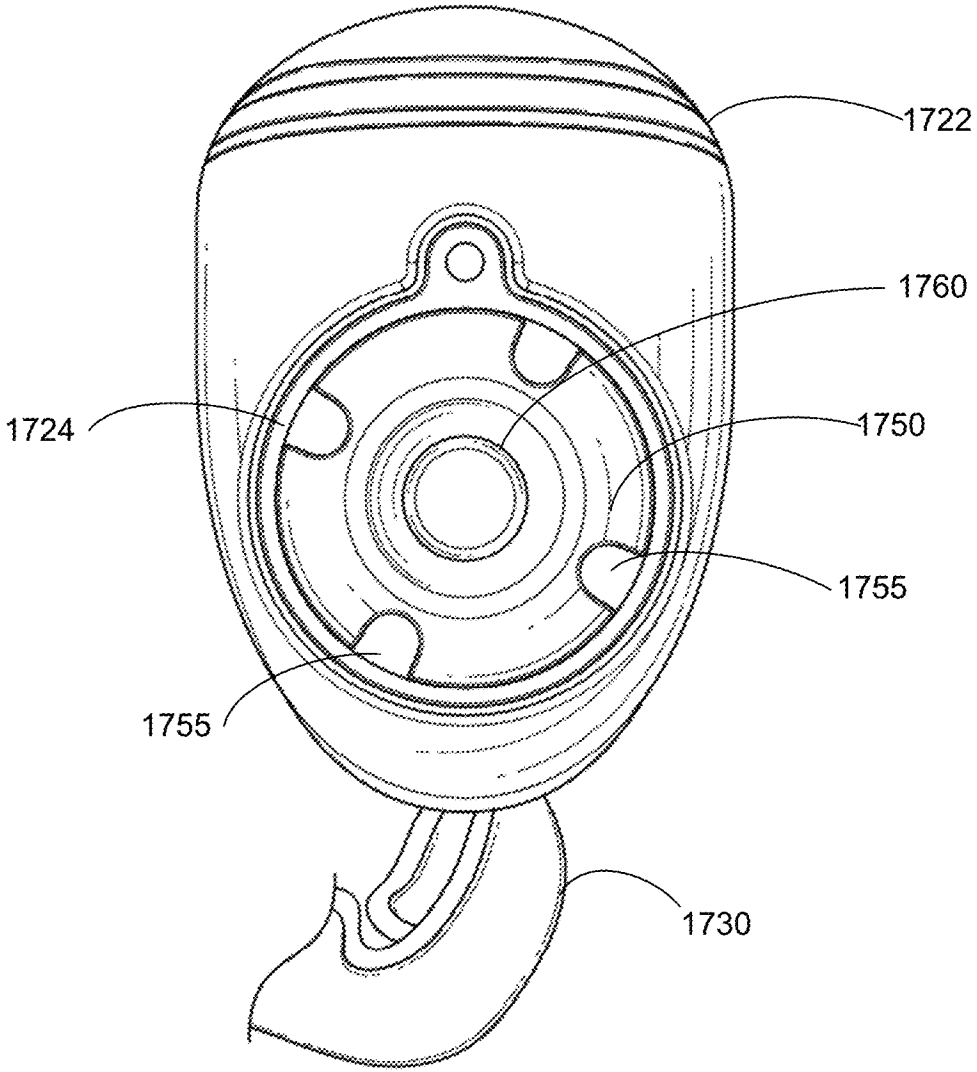

FIGS. 17A, 17B, and 17C depict perspective views of an exemplary embodiment of a handle assembly 1700. FIG. 17A depicts a side perspective view, FIG. 17B depicts an angled perspective view, and FIG. 17C depicts a top perspective view. In some embodiments, the handle assembly 1700 may comprise a grip handle 1710 within which illumination system 1720 may be secured, adjustable strap 1730, and attachment portion 1740, discussed further herein with regard to FIGS. 18A and 18B. As further depicted in FIG. 17B, illumination system 1720 may include one or more light sources 1721, 1722 and a communication port 1723. For instance, one or more light sources 1721, 1722 may include a light-emitting diode (LED) or a printed circuit board (PCB) with integrated LEDs and can receive power from a power source, such as a battery.

In some embodiments, one or more light sources 1721, 1722 may include a controller and control system for outputting control signals to the one or more light sources, which may be capable of illuminating light patterns in response to the control signals. In some embodiments, the control signals may be timed to produce predetermined current waveforms at predetermined frequencies or intervals. By way of example and not limitation, exemplary lighting effects may include, but are not limited to, constant on, blinking at predetermined intervals, walking, waterfall, random, or a combination of such effects. For example, the one or more light sources may be configured to blink in an SOS pattern in order to indicate that the user of the trekking pole 100 needs assistance.

In some embodiments, communication port 1723 may be a USB port. Further, communication port 1723 may facilitate battery charging and wired communication to the electronic components located within trekking pole 100. For example, communication port 1723 may allow a user to connect one or more user device (e.g., cell phone) to the handle assembly 1700 in order to receive power from a power source of the handle assembly 1700. In some embodiments, trekking pole 100 may include one or more environmental sensors, such as, for example, light sensors, gyroscopes, accelerometers, magnetometers, GPS, proximity sensors, etc. In certain embodiments where the trekking pole 100 may include one or more light sources 1721, 1722 oriented in a plurality of directions, such sensors can be utilized by controllers to selectively activate such illumination sources as would be necessary to project light in a desired direction, such as the front facing direction of a user. In some embodiments, communication port 1723 may allow a user to connect one or more user device (e.g., cell phone) to the handle assembly 1700 in order to receive data from the one or more sensors.

As depicted in FIG. 17C, handle assembly 1700 may further comprise additional light source 1724 and removably attachable power source housing cover 1750. As will be appreciated, light source 1724 may be positioned as to illuminate the removably attachable power source housing cover 1750. Further, power source housing cover 1750 may include spring loaded portion 1760 such that the power source may be selectively engageable by a user. For example, spring loaded portion 1760 may include a spring operable to expand and be contracted based on user input (e.g., pushing the spring loaded portion 1760 down).

Further, removably attachable power source housing cover 1750 may include one or more gripping members 1755. For example, gripping members 1755 may be cylindrically spaced about the removably attachable power source housing cover 1750 and may facilitate the removal of removably attachable power source housing cover 1750 from grip handle 1700. Additionally, and as previously discussed with reference to FIG. 7B and FIG. 8A, power source housing cover 1750 may comprise threads that are configured to mate with associated threads within an opening (not pictured) of grip handle 1700.

Figure 18A:
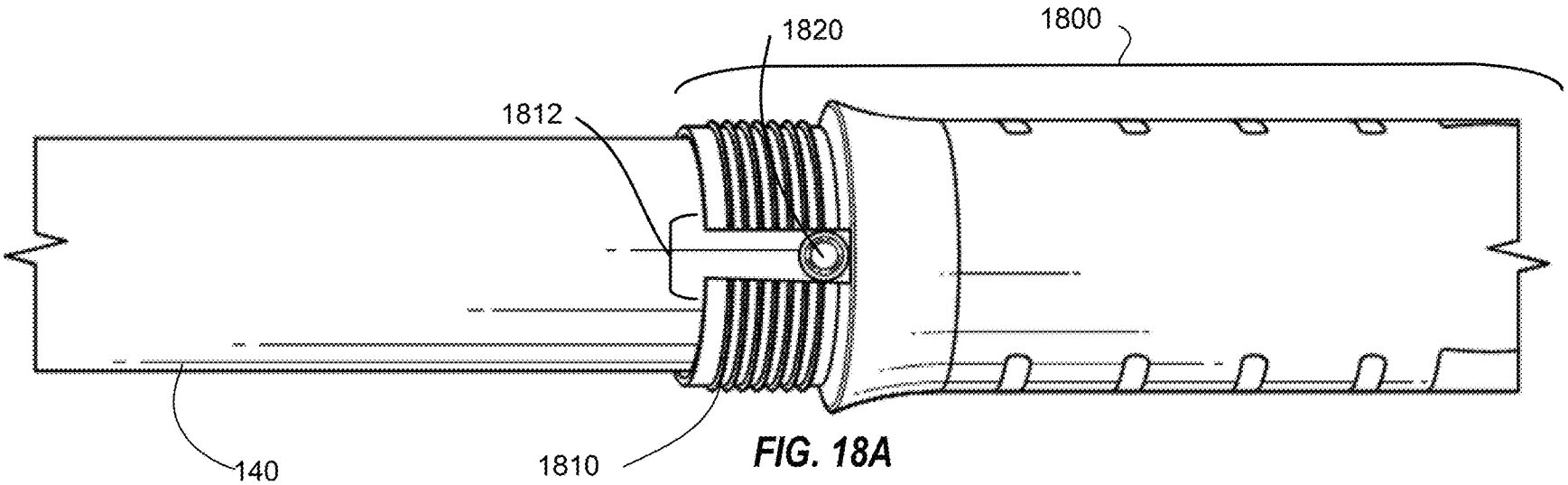
FIG. 18A is a perspective view illustrating a grip handle assembly attached to a shaft, according to an example embodiment of the present disclosure.
Figure 18B:
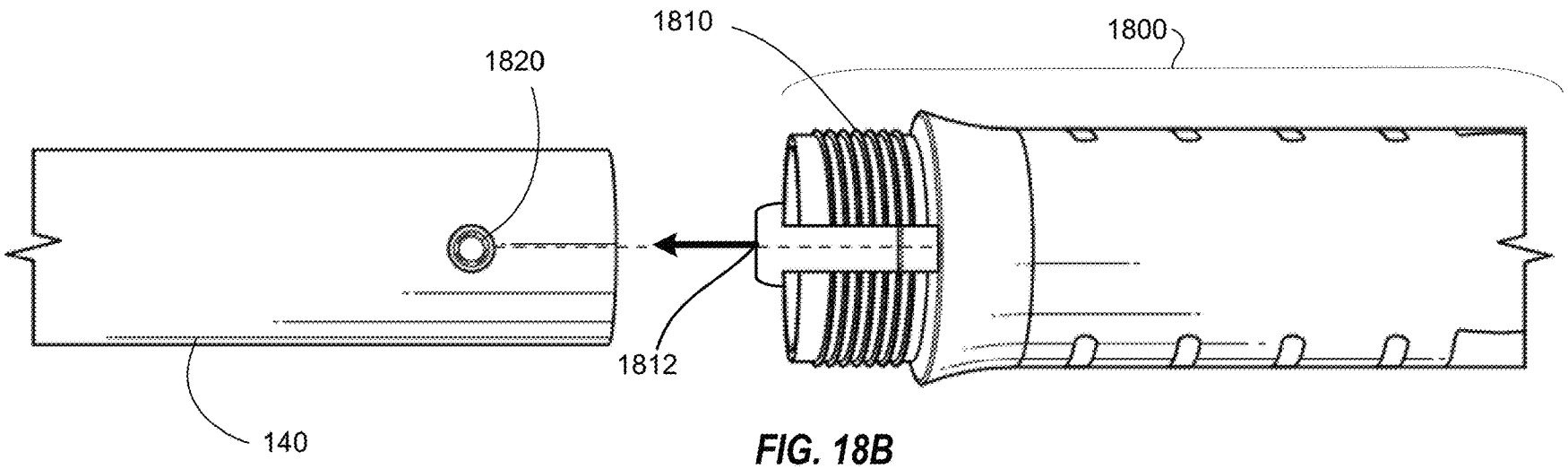
FIG. 18B is an exploded view illustrating the attachment of a grip handle assembly with a shaft, according to an example embodiment of the present disclosure.

FIG. 18A depicts a handle assembly 1800 detachably attached to hollow shaft 140. FIG. 18B depicts a handle assembly 1800 configured to detachably attached to hollow shaft 140. Handle assembly 1800 may include elements such as those previously described with regards to other handle assemblies (e.g., elements 120, 220, 1600, and/or 1700). As depicted in FIGS. 18A and 18B, handle assembly may include an attachment portion 1810, which may comprise a threaded portion and an alignment cutout 1812.

As further depicted, hollow shaft 140 may include an alignment pin 1820. As shown, when fully assembled, alignment pin 1820 may fit within alignment cutout 1812. It will be appreciated that the alignment pin 1820 may be advantageous as it prevents rotation of the handle assembly 1800 about a longitudinal axis. Threaded portion of attachment portion 1810 may be configured to mate with an attachment component (not pictured) such that the handle assembly 1800 abuts a top portion of alignment pin 1820 and an attachment component abuts a bottom portion of alignment pin 1820. In such an embodiment, handle assembly 1800 has limited lateral movement when attachment component and handle assembly 1800 are mated.

In certain embodiments, the handle assembly 1800 may comprise a material to confer desirable properties for the user during use. For example, the handle assembly 1800 may comprise a rubber material to improve grip during use. Further, handle assembly 1800 may comprise polypropylene for rigidity. Additionally, multiple handle assemblies 1800 comprising different materials may be provided in order for the user to detachably attach a preferred handle assembly 1800 based on certain situations and uses. In some embodiments, the handle assembly 1800 may have raised portions or ribbed portions to assist in improving grip ability and grip comfort during use.

While certain embodiments of the disclosed technology have been described in connection with what is presently considered to be the most practical embodiments, it is to be understood that the disclosed technology is not to be limited to the disclosed embodiments, but on the contrary, is intended to cover various modifications and equivalent arrangements included within the scope of the appended claims. Although specific terms are employed herein, they are used in a generic and descriptive sense only and not for purposes of limitation.

This written description uses examples to disclose certain embodiments of the disclosed technology, including the best mode, and also to enable any person skilled in the art to practice certain embodiments of the disclosed technology, including making and using any devices or systems and performing any incorporated methods. The patentable scope of certain embodiments of the disclosed technology is defined in the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A trekking pole comprising:

a substantially hollow shaft comprising a tip end, a grip end, and a cutout portion comprising:

a protective cover removably attached to an exterior surface of the substantially hollow shaft;

a first illumination system disposed on the exterior surface of the substantially hollow shaft, the first illumination system comprising:

one or more illumination sources secured to a circuit board; and a trunk collar attached to the grip end of the substantially hollow shaft, the trunk collar comprising a cutoff portion within which the first illumination system is secured;

a power source housing comprising:

a power source;

at least one internal electrical conductor at least partially contained within the substantially hollow shaft, the at least one internal electrical conductor configured to i) receive power from the power source, and ii) transfer power to the circuit board; and a power source housing cover including a spring, the spring operable to expand and contract based on a released force and an applied force, respectively;

a handle assembly attached to the substantially hollow shaft, the handle assembly comprising a handle grip and an adjustable strap; and a shaft tip assembly connectable to the tip end of the substantially hollow shaft, the shaft tip assembly comprising:

a tip member detachably connected to the substantially hollow shaft, the tip member comprising a threading;

a stopping flange;

a basket including an opening, the basket configured to attach to the tip member via the threading and stopping flange at the opening; and a securing device insertable through a securing mechanism.

2. The trekking pole of claim 1, wherein the protective cover further comprises one or more raised lens portions that allow light to project from the trekking pole.

3. The trekking pole of claim 1, wherein the circuit board comprises a controller and a control system, the controller and the control system configured to output control signals to the one or more illumination sources.

4. The trekking pole of claim 3, wherein the one or more illumination sources illuminate light patterns in response to the control signals.

5. The trekking pole of claim 1, wherein the circuit board comprises a printed circuit board.

6. The trekking pole of claim 1, the one or more illumination sources comprise Light-Emitting Diodes (LEDs).

7. The trekking pole of claim 1, wherein the handle assembly further comprises a second illumination system.

8. The trekking pole of claim 1, wherein the substantially hollow shaft further comprises grooves, notches, ribs, or any external surface modification of the like on the external surfaces of the grip end operable to rotationally lock the handle assembly in a predetermined position.

9. The trekking pole of claim 8, wherein the handle assembly is configured to detachably attach to the substantially hollow shaft.

10. The trekking pole of claim 9, wherein the handle assembly further comprises an attachable housing cover comprising a plurality of gripping members cylindrically spaced about the housing cover.

11. The trekking pole of claim 10, wherein the housing cover further comprises a plurality of threads configured to mate with corresponding threads of an opening the handle assembly.

12. The trekking pole of claim 1, wherein the power source housing is disposed on the exterior surface of the handle assembly.

13. The trekking pole of claim 1, wherein the power source housing is disposed on the exterior surface of the substantially hollow shaft.

14. The trekking pole of claim 1, wherein the handle grip has an opening sized to allow a clasped hand to fit within.

15. The trekking pole of claim 1, wherein the handle grip further comprises a second illumination system.

16. A trekking pole comprising:

a substantially hollow shaft comprising a tip end and a grip end; and a handle assembly removably attachable to the substantially hollow shaft, the handle assembly comprising:

a handle grip comprising a cutout portion;

an opening positioned at a top surface of the handle grip;

a power source housing comprising a power source housing cover removably attachable to the handle grip;

a button positioned at a top surface of the power source housing cover, the button configured to engage and disengage based on an applied force;

a seal gasket disposed between the power source housing cover and the handle grip;

an adjustable strap attached at a top side surface of the handle grip;

an illumination system positioned within the cutout portion of the handle grip, the illumination system comprising:

a protective cover configured to attach to and cover the cutout portion; and one or more illumination sources secured to a circuit board; and a shaft tip assembly connectable to the tip end of the substantially hollow shaft, the shaft tip assembly comprising:

a tip member detachably connected to the substantially hollow shaft, the tip member comprising a threading;

a stopping flange;

a basket including an opening, the basket configured to attach to the tip member via the threading and stopping flange at the opening; and a securing device insertable through a securing mechanism.

17. The trekking pole of claim 16, wherein the button facilitates illumination and de-illumination of the illumination system based on the button being engaged or disengaged, respectively.

18. The trekking pole of claim 16, wherein the button facilitates attachment and detachment to the handle grip based on the button being engaged or disengaged, respectively.

19. The trekking pole of claim 16, wherein the illumination system further comprises a heat dissipation device, a lens, and a lens holder.

20. A handle grip assembly comprising:

a handle grip positioned at a bottom portion of the handle grip assembly;

an illumination system positioned at a top portion of the handle grip assembly, the illumination system comprising:

one or more light sources; and a communication port;

an adjustable strap attached to a back portion of the illumination system;

an attachment portion positioned distal to the illumination system; and a power source housing comprising a power source housing cover removably attachable to the handle grip and a button positioned at a top surface of the power source housing cover, the button configured to engage and disengage based on an applied force, and the button facilitates attachment and detachment to the handle grip based on the button being engaged or disengaged, respectively.

21. The handle grip assembly of claim 20, wherein the button facilitates illumination and de-illumination of the illumination system based on the button being engaged or disengaged, respectively.

22. The handle grip assembly of claim 20, wherein the communication port is a universal serial bus (USB) port.

23. The handle grip assembly of claim 20, wherein the communication port facilitates charging of a power source of the handle grip assembly.

24. The handle grip assembly of claim 20, wherein the communication port facilitates wired communication with one or more electronic components.

25. The handle grip assembly of claim 20, wherein the attachment portion is removably attachable to a trekking pole.

26. The handle grip assembly of claim 20, wherein the power source housing cover comprises a plurality of gripping members cylindrically spaced about the power source housing cover.

27. The handle grip assembly of claim 26, wherein the plurality of gripping members facilitate removal of the power source housing cover from the handle grip.

28. The handle grip assembly of claim 20, wherein the attachment portion comprises a threaded portion and an alignment cutout, wherein:

the threaded portion facilitates attachment to a substantially hollow shaft of a trekking pole, and the alignment cutout is configured to engage a portion of the substantially hollow shaft of the trekking pole including an alignment pin that prevents rotation of the handle grip assembly about a longitudinal axis.

* * * * *